US005228308A

United States Patent [19]

Day et al.

[11] Patent Number: 5,228,308

[45] Date of Patent: Jul. 20, 1993

[54] REFRIGERATION SYSTEM AND REFRIGERANT FLOW CONTROL APPARATUS THEREFOR

[75] Inventors: James Day, Scotia; Heinz Jaster, Schenectady, both of N.Y.

[73] Assignee: General Electric Company, Schenectady, N.Y.

[21] Appl. No.: 612,290

[22] Filed: Nov. 9, 1990

[51] Int. Cl.[5] ..... F25B 41/00

[52] U.S. Cl. ..... 62/198; 62/526

[58] Field of Search ..... 62/200, 525, 526, 198, 62/117, 199

[56] References Cited

U.S. PATENT DOCUMENTS

| | | | |
|---|---|---|---|
| 2,081,883 | 5/1937 | Philipp | 62/115 |
| 2,123,497 | 6/1938 | Buchanan | 62/115 |
| 2,182,318 | 12/1939 | Newill | 62/4 |
| 2,316,066 | 4/1943 | Haymond | 62/200 X |
| 2,333,899 | 11/1943 | Stickel | 62/4 |
| 2,359,780 | 10/1944 | Muffly | 62/2 |
| 2,454,537 | 11/1948 | Atchison | 62/3 |
| 2,497,903 | 2/1950 | Muffly | 62/8 |
| 2,519,010 | 8/1950 | Zearfoss, Jr. | 62/115 |
| 2,539,908 | 1/1951 | Jenkins | 62/8 |
| 2,586,454 | 2/1952 | Brandin | 62/3 |
| 2,667,756 | 2/1954 | Atchison | 62/8 |
| 2,719,407 | 10/1955 | Zearfoss, Jr. | 62/6 |
| 2,755,634 | 7/1956 | Simmons | 62/4 |
| 2,844,945 | 7/1958 | Muffly | 62/160 |
| 3,786,648 | 1/1974 | Rice | 62/200 |
| 4,178,771 | 12/1980 | Karll | 62/200 |
| 4,237,698 | 12/1980 | Mount | 62/197 |
| 4,240,263 | 12/1980 | Brendel | 62/115 |

(List continued on next page.)

FOREIGN PATENT DOCUMENTS

| | | |
|---|---|---|
| 115703 | 9/1941 | Australia . |
| 192526 | 1/1986 | European Pat. Off. . |
| 0377158 | 7/1990 | European Pat. Off. . |
| 3339806 | 5/1985 | Fed. Rep. of Germany . |
| 2295374 | 6/1974 | France . |
| 431893 | 7/1976 | France . |
| 2500421 | 2/1982 | France . |
| 504515 | 3/1972 | U.S.S.R. . |
| 1057753 | 4/1982 | U.S.S.R. . |
| 1134858 | 1/1985 | U.S.S.R. . |
| 639691 | 7/1950 | United Kingdom . |

OTHER PUBLICATIONS

"Refrigeration and Air Conditioning" by W. F. Stoecker, McGraw-Hill Series in Mechanical Engineering, New York, 1958, pp. 56-61.

"Heat Pumps—Limitations and Potential" by J. B. Comly et al., General Electric Technical Information Series, Report No. 75CRD185, Sep. 1975, pp. 7, 8 and 18.

"Principles of Refrigeration" by R. J. Dossat, John Wiley and Sons, New York, pp. 240, 241, 430 and 536.

*Primary Examiner*—William E. Wayner

*Attorney, Agent, or Firm*—Patrick R. Scanlon; Paul R. Webb, II

[57] ABSTRACT

A refrigerant flow control unit for a refrigeration system, particularly a refrigeration system having a compressor, a condenser connected to receive refrigerant discharged from the compressor, and a plurality of evaporators. A first one of the evaporators is connected to receive at least a portion of the refrigerant discharged from the condenser and the remaining evaporators are connected to receive at least a portion of the refrigerant discharged from another evaporator. The refrigerant flow control unit is connected to receive at least a portion of the refrigerant discharged from each one of the evaporators. The refrigerant flow control unit is also connected to the compressor and is repeatedly operable to alternately connect one of the evaporators respectively in exclusive refrigerant flow relationship with the compressor. In one preferred embodiment, the refrigerant flow control unit is operated in accordance with measurable physical attributes of one or more of the evaporators, such as pressure, temperature, density of mass flow rate.

65 Claims, 12 Drawing Sheets

U.S. PATENT DOCUMENTS

| | | | |
|---|---|---|---|
| 4,242,116 | 12/1980 | Aschberger et al. | 62/199 |
| 4,242,880 | 1/1981 | Niida | 62/200 |
| 4,262,496 | 4/1981 | Bell, Jr. | 62/504 |
| 4,317,335 | 3/1982 | Nakagawa et al. | 62/199 |
| 4,332,138 | 6/1982 | Nakagawa et al. | 62/199 |
| 4,373,353 | 2/1983 | Anzalone | 62/200 |
| 4,416,119 | 11/1983 | Wilson et al. | 62/149 |
| 4,439,998 | 4/1984 | Horvay et al. | 62/199 |
| 4,474,026 | 10/1984 | Mochizuki et al. | 62/157 |
| 4,513,581 | 4/1985 | Mizobuchi et al. | 62/197 |
| 4,691,527 | 9/1987 | Ikeda | 62/234 |
| 4,771,610 | 9/1988 | Nakashima et al. | 62/160 |
| 4,829,889 | 5/1989 | Takeuchi et al. | 99/289 P |
| 4,862,707 | 9/1989 | Hill et al. | 62/431 |
| 4,873,837 | 10/1989 | Murray | 62/199 |
| 4,910,972 | 3/1990 | Jaster | 62/335 |
| 4,918,942 | 4/1990 | Jaster | 62/335 |
| 4,966,010 | 10/1990 | Jaster et al. | 62/179 |

REFRIGERATION SYSTEM AND REFRIGERANT FLOW CONTROL APPARATUS THEREFOR

BACKGROUND OF THE INVENTION

1. Field of the Invention

The present invention generally relates to refrigeration systems and, more particularly, relates to refrigeration systems including a plurality of evaporators and a compressor unit.

2. Related Art

In a typical refrigeration system, refrigerant circulates continuously through a closed circuit. The term "circuit", as used herein, refers to a physical apparatus whereas the term "cycle" as used herein refers to operation of a circuit, e.g., refrigerant cycles in a refrigeration circuit. The term "refrigerant", as used herein, refers to refrigerant in a liquid, vapor and/or gas form. Components of the closed circuit cause the refrigerant to undergo temperature/pressure changes. The temperature/pressure changes of the refrigerant result in energy transfer. Typical components of a refrigeration system include, for example, compressors, condensers, evaporators, control valve, and connecting piping. Details with regard to some known refrigeration systems are set forth in Baumeister et al., Standard Handbook for Mechanical Engineers, McGraw Hill Book Company, Eight Edition, 1979, beginning at page 19-6.

Energy efficiency is one important factor in the implementation of refrigeration systems. Particularly, an ideal refrigeration system provides an ideal refrigeration effect. In practice, an actual refrigeration system provides an actual refrigeration effect less than the ideal refrigeration effect. The actual refrigeration effect provided varies from system to system.

Increased energy efficiency typically is achieved by utilizing more expensive and more efficient refrigerant system components, adding extra insulation adjacent to the area to be refrigerated, or by other costly additions. Increasing the energy efficiency of a refrigeration system therefore usually results in an increase in the cost of the system. It is desirable, of course, to increase the efficiency of a refrigeration system and minimize any increase in the cost of the system.

In some apparatus utilizing refrigeration systems, more than one area is to be refrigerated, and at least one area requires more refrigeration than another area. A typical household refrigerator, which includes a freezer compartment and a fresh food compartment, is one example of such an apparatus. The freezer compartment preferably is maintained between −10° Fahrenheit (F) and +15° F., and the fresh food compartment preferably is maintained between +33° F. and +47° F.

To meet these temperature requirements, a typical refrigeration system includes a compressor coupled to an evaporator disposed within the household refrigerator. The terms "coupled" and "connected" are used herein interchangeably. When two components are coupled or connected, this means that the components are linked, directly or indirectly in some manner in refrigerant flow relationship. Another component or other components can be intervening between coupled or connected components. For example, even though other components such as a pressure sensor or an expander are connected or coupled in the link between the compressor and evaporator, the compressor and evaporator are still coupled or connected.

Referring again to the refrigeration system for a typical household refrigerator, the evaporator is operated so that it is maintained at approximately −10° F. (an actual range of approximately −30° F. to 0° F. typically is used) and air is blown across the coils of the evaporator. The flow of the evaporator-cooled air is controlled, for example, by barriers. A first portion of the evaporator-cooled air is directed to the freezer compartment and a second portion of the evaporator-cooled air is directed to the fresh food compartment. To cool a fresh food compartment, rather than utilizing evaporator-cooled air from an evaporator operating at −10° F., it is possible to utilize an evaporator operating at, for example, +25° F. (or a range of approximately +15° F. to +32° F.) The typical refrigeration system utilized in household refrigerators, therefore, produces its refrigeration effect by operating an evaporator at a temperature which is appropriate for the freezer compartment but lower than it needs to be for the fresh food compartment.

It is well-known that the energy required to maintain an evaporator at −10 ° F. is greater than the energy required to maintain an evaporator at +25° F. in a refrigerator. The typical household refrigerator therefore uses more energy to cool the fresh food compartment than is necessary. Using more energy than is necessary results in reduced energy efficiency.

The above referenced household refrigerator example is provided for illustrative purposes only. Many apparatus other than household refrigerators utilize refrigeration systems which include an evaporator operating at a temperature below a temperature at which the evaporator actually needs to operate.

Refrigeration systems which reduce energy use are described in commonly assigned U.S. Pat. Nos. 4,910,972 and 4,918,942. The patented systems utilize at least two evaporators and a plurality of compressors or a compressor having a plurality of stages. For example, in a dual, i.e., two, evaporator circuit for household refrigerators, a first evaporator operates at +25° F. and a second evaporator operates at −10° F. Air cooled by the first evaporator is utilized for the fresh food compartment and air cooled by the second evaporator is utilized for the freezer compartment. Utilizing the dual evaporator refrigeration system in a household refrigerator results in increased energy efficiency. Energy is conserved by operating the first evaporator at the temperature (e.g., +25° F.) required for the fresh food compartment rather than operating an evaporator for the fresh food compartment at −10° F. Other features of the patented systems also facilitate increased energy efficiencies.

To drive the plurality of evaporators in the refrigeration systems described in U.S. Pat. Nos. 4,910,972 and 4,918,942, and as mentioned above, a plurality of compressors or a compressor including a plurality of stages are utilized. Utilizing a plurality of compressors or utilizing a compressor having a plurality of stages results in increasing the cost of the refrigeration system over the cost, at least initially, of refrigeration systems utilizing one evaporator and one single stage compressor. It is desirable to provide improved energy efficiency achieved using a plurality of evaporators and to minimize, if not eliminate, the increase in cost associated with using a plurality of compressors or a compressor having a plurality of stages.

It is an object of the present invention to provide a refrigeration system which includes a single compressor unit coupled, directly or indirectly, to a plurality of evaporators.

Another object of the present invention is to provide a refrigeration system in which a single compressor unit alternately receives refrigerant flows having different, respective, pressures.

Yet another object of the present invention is to provide a refrigeration system which exhibits increased energy efficiency and minimizes any cost increases.

Still another object of the present invention is to provide a refrigeration system for a household refrigerator.

SUMMARY OF THE INVENTION

The present invention relates to a refrigerant flow control unit for a refrigeration system, particularly a refrigeration system comprising a compressor, a condenser connected to receive refrigerant discharged from the compressor, and a plurality of evaporators. Furthermore, a first one of the evaporators is connected to receive at least a portion of the refrigerant discharged from the condenser and the remaining evaporators are connected to receive at least a portion of the refrigerant discharge from another evaporator. The refrigerant flow control unit is connected to receive at least a portion of the refrigerant discharged from each one of the evaporators. The refrigerant flow control unit is also connected to the compressor and is repeatedly operable to alternately connect one of the evaporators respectively in exclusive refrigerant flow relationship with the compressor. In one preferred embodiment, the refrigerant flow control unit is operated in accordance with measurable physical attributes of one or more of the evaporators, such as pressure, temperature, density or mass flow rate.

The present invention provides increased energy efficiency by utilizing a plurality of evaporators which operate at desired, respective, refrigeration temperatures. Further, by utilizing, in one embodiment, a single-stage compressor rather than a plurality of compressors or a compressor having a plurality of stages, increased costs associated with the improved energy efficiency are minimized.

BRIEF DESCRIPTION OF THE DRAWINGS

These and other objects of the present invention, together with further features and advantages thereof, will become apparent from the following detailed specification when read together with the accompanying drawings, in which.

DETAILED DESCRIPTION OF THE DRAWINGS

The present invention, as described herein, is believed to have its greatest utility in refrigeration systems and particularly in household refrigerator freezers. The present invention, however, has utility in other refrigeration applications such as control of multiple air conditioner units. The term refrigeration systems, as used herein, therefore not only refers to refrigerator/freezers but also to many other types of refrigeration applications.

Figure 1:
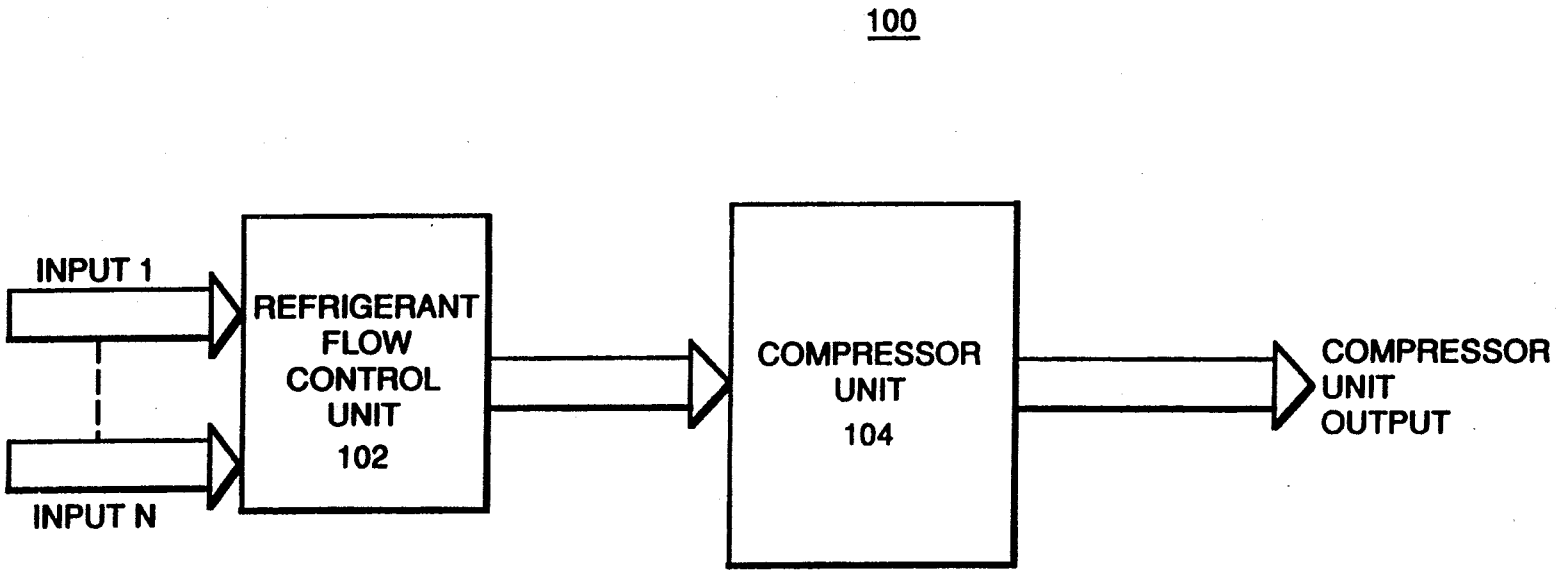
FIG. 1 is a block diagram illustrating a refrigerant flow control unit and a compressor unit.

Referring now more particularly to the drawings, FIG. 1 shows a block diagram 100 illustrating a refrigerant flow control unit 102 and a compressor unit 104 in accordance with the present invention. A plurality of inputs INPUT 1–INPUT N are shown as being supplied to the control unit 102. The inputs to the control unit 102 typically are refrigerants. Refrigerant conduits, for example, are coupled to or formed integral with the control unit 102 for supplying input refrigerant. More details with regard to alternate embodiments for the refrigerant flow control unit 102 are provided hereinafter, and particularly with reference to FIGS. 2B–C, 4 and 5.

The output from the control unit 102 is supplied as input to the compressor unit 104. The compressor unit 104 comprises means for compressing refrigerant such as a single-stage compressor, a compressor having a plurality of stages, or a plurality of compressors, which provides, as output, compressed refrigerant. Embodiments of the present invention wherein a single stage compressor is utilized are believed to have greatest utility.

Figure 2A:
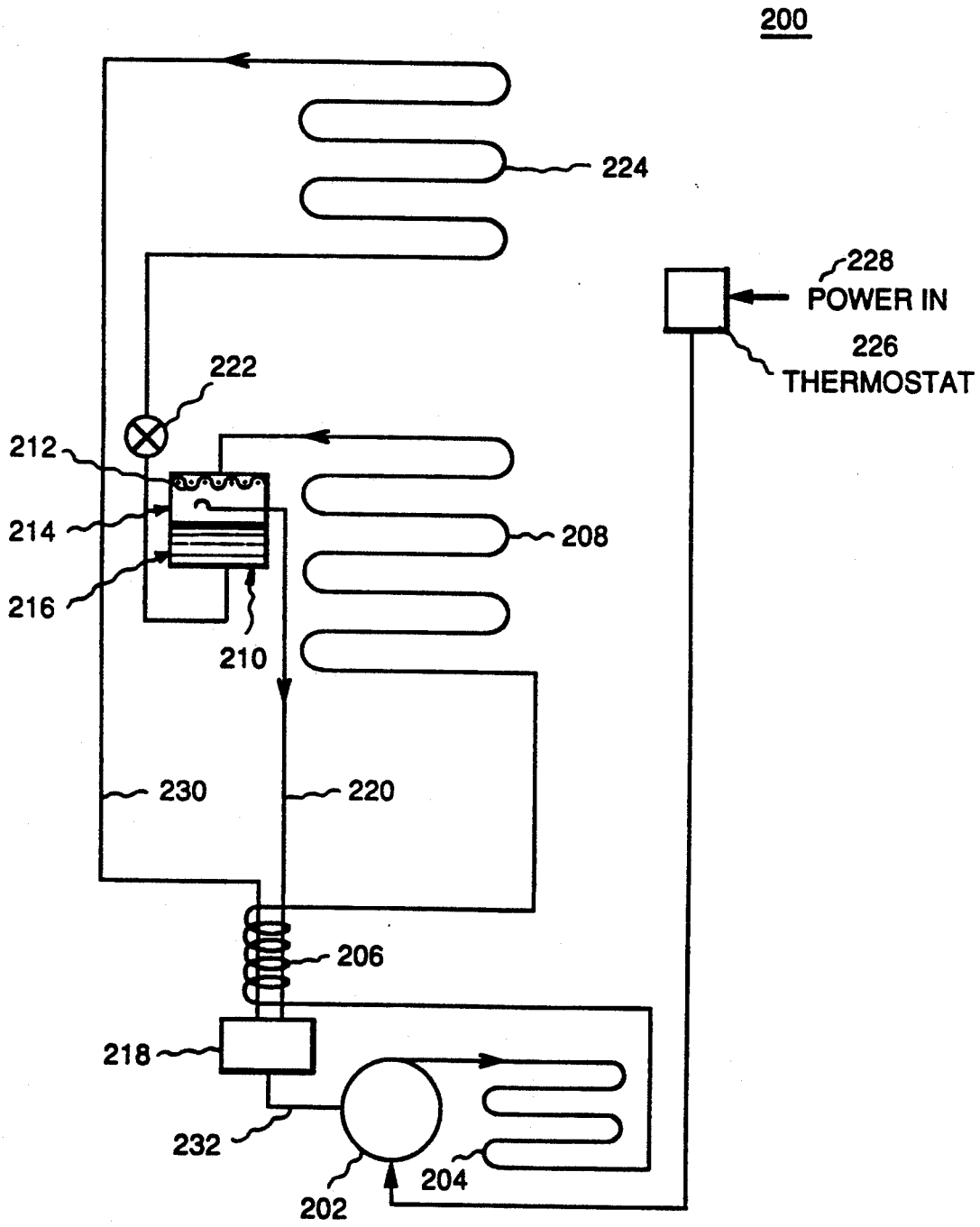
FIG. 2A illustrates a first embodiment of a refrigeration system.

FIG. 2A illustrates a first embodiment 200 of a refrigeration system in accordance with one form of the present invention is illustrated. The refrigeration system 200 includes a compressor unit 202 coupled to a condenser 204. A capillary tube 206 is coupled to the outlet of the condenser 204, and a first evaporator 208 is coupled to the outlet of the capillary tube 206. The outlet of the first evaporator 208 is coupled to the inlet of a phase separator 210. The phase separator 210 includes a screen 212 disposed adjacent the phase separator inlet, a gas, or vapor, containing portion 214 and a liquid containing portion 216. Although sometimes referred to herein as the vapor containing portion 214, or simply as the vapor portion 214, it should be understood that this portion of the phase separator 210 may have gas and/or vapor disposed therein. The phase separator vapor portion 214 is coupled to supply refrigerant, as a first input, to a refrigerant flow control unit 218. Particularly, a conduit 220 extends from the phase separator vapor portion 214 to the control unit 218. The conduit 220 is arranged so that liquid refrigerant entering the phase separator vapor portion 214 passes through the vapor portion 214 and cannot enter the open end of the conduit 220. The outlet of the phase separator liquid portion 216 is coupled to an expansion device 222, such as an expansion valve or a capillary tube. The expansion device 222 is sometimes referred to herein as a throttle. A second evaporator 224 is coupled to the outlet of the expansion device 222, and the outlet of the second evaporator 224 is coupled to provide refrigerant, as a second input, to the refrigerant flow control unit 218.

A thermostat 226, which preferably is user adjustable, receives current flow from an external power source designated by the legend "POWER IN" 228 and the thermostat 226 is connected to the compressor unit 202. When cooling is required, the thermostat provides an output signal which activates the compressor unit 202. In a household refrigerator, for example, the thermostat 226 preferably is disposed in the freezer compartment.

The capillary tube 206 is shown in thermal contact with the conduit 220 which connects the phase separator vapor portion 214 with the refrigerant flow control unit 218. The capillary tube 206 also is in thermal contact with a conduit 230 which couples the second evaporator 224 to the refrigerant flow control unit 218. Thermal contact is achieved, for example, by soldering the exterior of the capillary tube 206 and a portion of the exterior of the conduits 220 and 230 together side-by-side. The capillary tube 206 is shown as being wrapped around the conduits 220 and 230 as schematic representation of a heat transfer relationship. The heat transfer occurs in a counterflow arrangement, i.e., the refrigerant flowing in the capillary tube 206 proceeds in a direction opposite to the flow of refrigerant in the conduits 220 and 230. As is well known in the art, using a counterflow heat exchange arrangement, rather than a heat exchange arrangement wherein the flows proceed in a same direction, increases the heat exchange efficiency.

In operation, and by way of example, the first evaporator 208 contains refrigerant at a temperature of approximately +25° F. The second evaporator 224 contains refrigerant at a temperature of approximately −10° F. The expansion device 222 is adjusted to provide just barely superheated vapor flow at the outlet of the second evaporator 224. A capillary tube (not shown) having the appropriate bore size and length or an expansion valve can be used as the expansion device 222.

The control unit 218 controls the flow of refrigerant through the respective evaporators 208 and 224 to the compressor unit 202. When refrigeration is called for, the thermostat 226 activates the compressor unit 202. When the compressor unit 202 is operating, vapor enters the compressor unit 202 through the refrigeration flow control unit 218 from the second evaporator 224 when the control unit 218 is configured to allow the conduits 230 and 232 to be in flow communication. When the compressor unit 202 is operating, vapor from the phase separator 210 enters the compressor unit 202 through the refrigeration flow control unit 218 when the control unit 218 is configured to allow the conduits 220 and 232 to be in flow communication. For ease of reference, when the control unit 218 is configured to provide flow communication between the conduits 230 and 232, or similary disposed conduits, this condition is hereinafter referred to as STATE 1. When the control unit 218 is configured to provide flow communication between the conduits 220 and 232, or similarly disposed conduits, this condition is hereinafter referred to as STATE 2.

In the exemplified operation, and using refrigerant R-12 (dichlorodifluoromethane), refrigerant at 20 pounds per square inch absolute (psia) is disposed in the conduit 230 and refrigerant at 40 psia is disposed in the conduit 220. The inlet pressure to the compressor unit 202 is approximately 20 psia when the control unit 218is in STATE 1. When the control unit 218 is in STATE 2, the compressor unit inlet pressure is approximately 40 psia.

At the time of transition from STATE 1 to STATE 2, flow communication between the conduit 230 and the conduit 232 is interrupted, refrigerant discontinues flowing through the second evaporator 224 and refrigerant only flows through the first evaporator 208. At the time of transition from STATE 2 to STATE 1, flow communication between the conduit 220 and the conduit 232 is interrupted, liquid refrigerant from the phase separator 210 begins flowing through the second evaporator 224 and refrigerant continues flowing through the first evaporator 208, albeit at a slower rate.

More particularly, when the thermostat 226 activates the compressor unit 202, such as when the temperature of the freezer compartment falls below some predetermined temperature, and when the control unit 218 is in STATE 2, the high temperature, high pressure gas discharged from the compressor unit 202 is condensed in the condenser 204. The capillary tube 206 is sized to obtain some subcooling of the liquid exiting the condenser 204. The capillary tube 206 is a fixed length, small bore tube. Because of the small capillary tube diameter, a high pressure drop occurs across the capillary tube length reducing the pressure of the refrigerant to its saturation pressure. Some of the refrigerant evaporates in the capillary tube 206 and at least some of the refrigerant evaporates in the first evaporator 208 and changes to a vapor. The capillary tube 206 meters the flow of refrigerant and maintains a pressure difference between the condenser 204 and the first evaporator 208.

The direct contact between the outside of the warm capillary tube 206 into which the warm condensed liquid from the condenser 204 enters and the outside of the conduit 220 from the phase separator causes the cooler conduit 220 to warm and the capillary tube 206 to cool. Without heating from the capillary tube 206, the temperatures for the conduits 220 and 230 in STATE 1 and STATE 2, respectively, in the present embodiment are approximately −10° F. and +25° F., respectively. Without heating from the capillary tube 206, moisture from the room temperature air will condense on the conduits 220 and 230. The condensing moisture also tends to drip, creating a separate problem. Conduit heating by means of the capillary tube 206 warms the conduits 220 and 230 sufficiently to avoid condensation and also cools the refrigerant in the capillary tube 206 flowing to the first evaporator 208. Warming of the refrigerant in the conduits 220 and 230 has an adverse effect on efficiency but when combined with the beneficial effect of the cooling of the refrigerant in the capillary tube 206, overall system efficiency increases.

The expansion of the liquid refrigerant in the first evaporator 208 causes part of the liquid refrigerant to evaporate. Liquid and vapor refrigerant from the first evaporator 208 then enters the phase separator 210. Liquid refrigerant accumulates in the liquid portion 216 and vapor accumulates in the vapor portion 214 of the phase separator 210. The conduit 220 supplies vapor from the vapor portion 214 to the control unit 218. The vapor from the phase separator 210 is at approximately +25° F.

When the thermostat 226 activates the compressor unit 202, and when the control unit 218 is in STATE 1, the liquid from the liquid portion 216 of the phase separate 210 flows through the throttle 222 causing the refrigerant to be at a still lower pressure. The remaining liquid refrigerant evaporates in the second evaporator 224, thereby cooling the second evaporator 224 to approximately −10° F. As previously stated, refrigerant flows, albeit at a slow rate, through the first evaporator 208 when the control unit 218 is in STATE 1. A sufficient refrigerant charge is supplied to the system 200 so that a desired liquid level can be maintained in the phase separator 210.

The pressure at the input of the compressor unit 202 when the control unit 218 is in STATE 1 is determined by the pressure at which the refrigerant exists in two-phase equilibrium at −10° F. The pressure at the compressor unit 202 when the control unit 218 is in STATE 2 is determined by the saturation pressure of the refrigerant at +25° F. The temperature of the condenser 204 has to be greater than that of the ambient temperature in order to function as a condenser. The refrigerant within the condenser 204, for example, is at +105° F. The pressure of refrigerant in the condensor 206, of course, depends upon the refrigerant selected.

The compressor unit 202 is any type of compressor or mechanism which provides a compressed refrigerant output. For example, the compressor unit 202 is a single stage compressor, a plurality of compressors, a compressor having a plurality of stages, or any combination of compressors. The compressor unit 202 is, for example, a rotary or reciprocating type compressor. A compressor with a small volume inlet chamber is preferred since two different pressure gases are alternately being compressed. If a compressor with a large inlet chamber is used, there is a substantial delay between the time when the high pressure refrigerant stops flowing to the compressor and the time when the inlet compressor pressure is reduced sufficiently to start compressing the lower pressure refrigerant. Using a large inlet chamber also reduces the system efficiency. A rotary compressor with an inlet chamber volume of one cubic inch which compresses 0.28 cubic inches per compressor revolution, for example, is satisfactory.

Figure 2B:
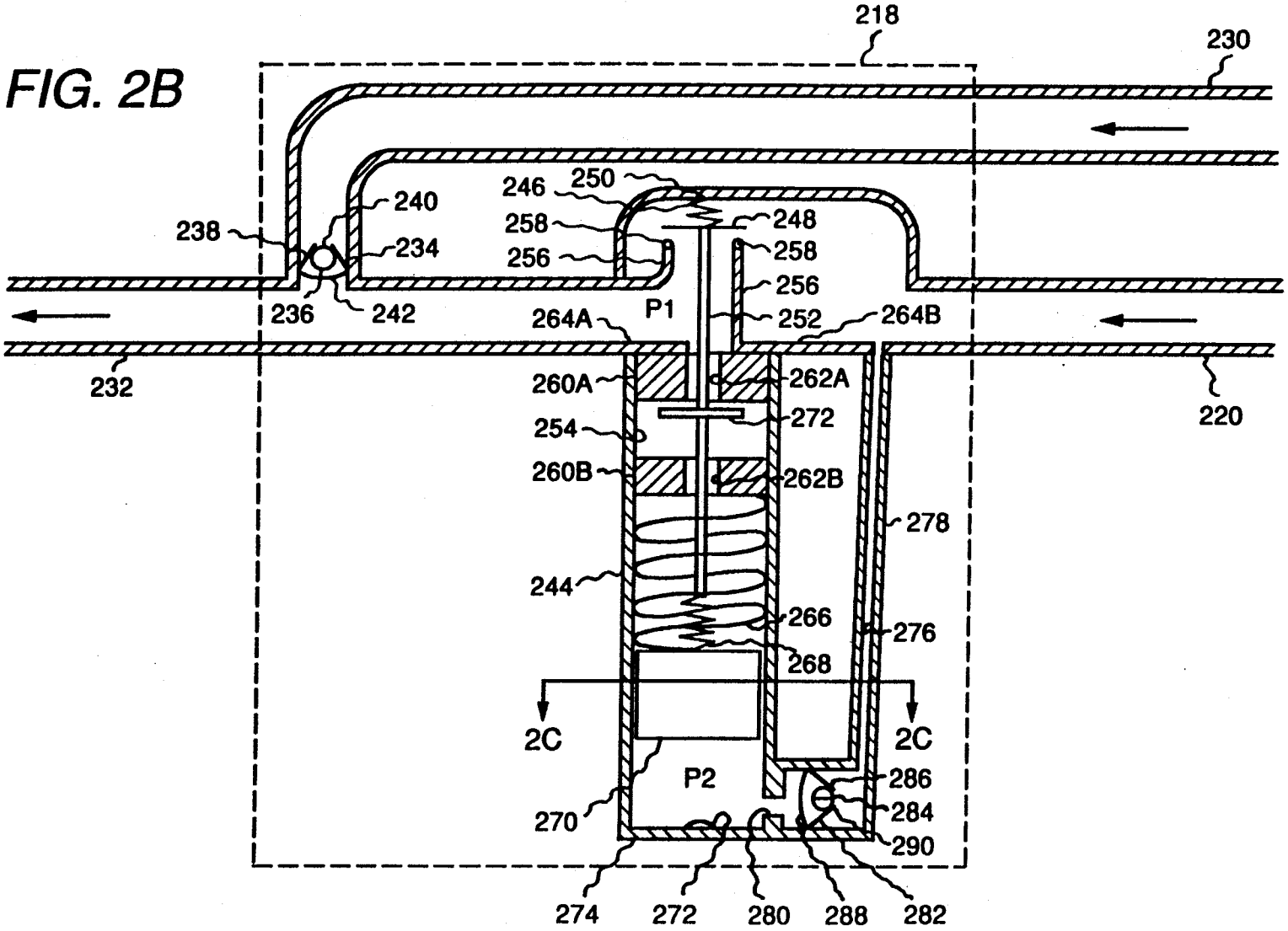
FIG. 2B shows, in more detail, a first embodiment of a refrigerant flow control unit included in the refrigeration system of FIG. 2A.

FIG. 2B illustrates, in more detail, a first embodiment of the refrigerant flow control unit 218. Particularly, the unit 218 is shown as being integrally formed with the conduits 220, 230 and 232. The conduits 220, 230 and 232 are coupled to or integrally formed with the control unit 218. For example, rather than being integrally formed with the unit 218, inlet conduits and an outlet conduit (not shown) could be provided for the unit 218. The conduits 220, 230 and 232 then are coupled to the respective inlets and outlet of the unit 218 such as by welding, soldering, using a mechanical coupler, etc.

The control unit 218 includes a first flow controller 234, shown as a first ball-type check valve, disposed in the conduit 230. The first check valve 234 is shown as being in a closed position, i.e., refrigerant cannot flow between the conduit 230 and the conduit 232. Particularly, the check valve 234 includes a ball 236 and a ball seat 238 including an opening 240. A cage 242 prevents the ball 236 from escaping when the pressure in the conduit 230 is greater than the pressure in the conduit 232. When the ball 236 is forced into the seat 238 from the pressure of refrigerant in the conduit 232, the first check valve 234 is closed and refrigerant cannot flow between the conduit 230 and the conduit 232. The location and type of flow controller for the first flow controller 234, of course, may differ from the location and type shown in FIG. 2B. For example, the first flow controller 234 may be an electric valve mechanism and the controller 234 may be located anywhere along the length of the conduit 220. To minimize any delay between switching from one refrigerant flow to another, it is desirable to locate the flow controller 234 as close as possible to the conduit 232, as shown in FIG. 2B.

A second flow controller 244 is shown as being disposed, at least partially, within the conduit 220. In FIG. 2B, the second flow controller 244 is shown as being open so that refrigerant can flow from the conduit 220 to the conduit 232, i.e., STATE 2. The second flow controller 244 includes a valve cover spring 246 and an annular-shaped valve cover 248. The valve cover spring is connected to, at one end, a wall 250 of the conduit 220 and is connected, at its other end, to the valve cover 248. A valve stem, or linkage, 252 is coupled, or integrally formed, with the valve cover 248. The valve stem 252 extends from the valve cover 248 into a cylinder chamber 254. A valve seat 256, shown in cross-section, has an annular shape and is disposed in the conduit 220. The valve seat 256 includes a valve seat contact 258. The valve cover spring 246 biases the valve cover 248 towards the valve seat contact 258.

The second flow controller 244 further includes first and second annular-shaped magnets 260A and 260B disposed in the cylinder chamber 254 in a spaced relationship. The magnets 260A and 260B are shown in cross-section and have annular-shaped openings 262A and 262B, respectively, therein. Portions of the valve stem 252 pass through the openings 262A and 262B. The first magnet 260A is fixed against a portion of cylinder walls 264A and 264B adjacent the conduit 220. The position of the second magnet 260B is fixed and selected, as hereinafter described in more detail so that the valve cover 248 can e disposed, alternately, in an open and a closed position. The second flow controller 244 further includes a piston return spring 266, a valve stem spring 268, and a piston 270. The piston return spring 266 is connected at one end to the second magnet 260B and at its other end to the piston 270. The valve stem spring 268 is connected at one end to the valve stem 252 and at its other end to the piston 270. A magnetic disk 272 is connected to the valve stem 252 at a location between the first magnet 260A and he second magnet 260B. The magnetic disk 272 is sized so that it cannot pass through the openings 262A or 262B.

A piston stop 272 is disposed at an end 274 of the cylinder chamber 254. The cylinder chamber 254 is in refrigerant flow communication with a passage 276, formed in a tube 278, through an opening 280. A second check valve 282, known in the art as a balltype orifice check valve, is disposed between the opening 280 and the passage 276. The orifice check valve 282 allows free flow of a refrigerant from the passage 276 to the chamber 254 and allows restricted flow of refrigerant from the chamber 254 to the passage 276. Particularly, the orifice check valve 282 includes a ball 284 and a ball seat 286. A cage 288 prevents the ball 284 from escaping when the pressure of refrigerant in the passage 276 is greater than the pressure of refrigerant in the cylinder chamber 254. A small opening 290, or orifice, extends through the ball 284, as shown in cross-section, and refrigerant will flow, albeit in a restricted manner, through the orifice 290 from the cylinder chamber 254 to the passage 276 when the chamber pressure exceeds the passage pressure. Refrigerant flow through the passage 276 between the cylinder chamber 254 and to the conduit 220, with the direction being determined by the pressure differential.

Figure 2C:
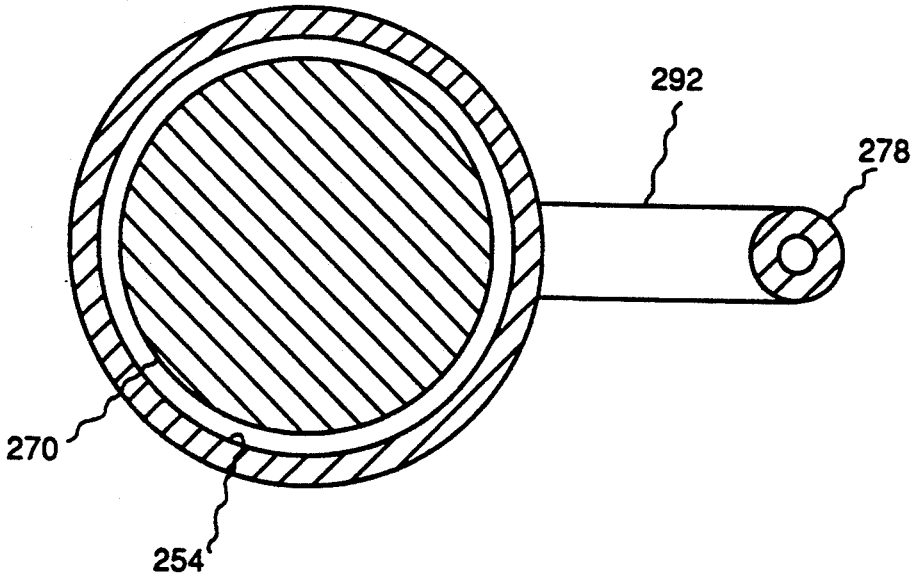
FIG. 2C is a cross-sectional view through line 2C—2C of the refrigerant flow control unit shown in FIG. 2B.

A cross-sectional view through line 2C—2C of FIG. 2B is illustrated in FIG. 2C. In FIG. 2C, the relationship between the piston chamber 254 and the tube 278 is clearly illustrated. The piston 270 is disposed within the chamber 254 and has a diameter slightly smaller than the diameter of the piston chamber 254. A gasket (not shown), or some type of seal, is disposed between the piston 270 and the piston chamber wall in order to facilitate isolation of the pressure P1 of the refrigerant disposed in the conduit 232 from the pressure P2 of the refrigerant disposed between the piston 270 and the cylinder chamber end 274. A ring-type seal, for example, is coupled to the piston 270 and is in pressure-sealing contact with the piston chamber wall. The second check valve 282 (not shown in FIG. 2C) is disposed in a portion of a connecting conduit 292. The cylinder chamber 254, the connecting conduit 292, and the tube 278 are shown as being integrally coupled, however, it should be understood that these components may be coupled by soldering, welding, mechanical couplers, etc.

Rather than being constructed as shown in FIGS. 2B–C, it is contemplated that the second flow controller 244 can be constructed, for example, from a single block of material such as a plastic or steel. Particularly, in an alternative embodiment, the cylinder chamber 254 and a passage (in place of the tube 278) are formed by drilling and forming openings in the block. Many other techniques, such as plastic molding, also could be utilized to make the controller 244.

The location and type of flow controller for the second flow controller 244, of course, may differ from the location and type shown in FIGS. 2B–C. For example, the second flow controller 244 may be an electronic valve mechanism and the controller 244 may be located anywhere along the length of second conduit 220. To minimize any delay between switching from one refrigerant flow to another, it is desirable to locate the flow controller 244 as close as possible to the conduit 232 as shown in FIG. 2B.

In operation, and by way of example, the conduit 230 has a low pressure refrigerant, e.g., 20 psia, flowing therethrough and the conduit 220 has a higher pressure refrigerant, e.g., 40 psia, flowing therethrough. The valve stem side of the piston 270 is at a pressure P1, where pressure P1 is equal to the pressure of refrigerant disposed in the conduit 232. Pressure P1 is sometimes referred to herein as the compressor unit inlet pressure. Pressure P1 would alternate, in this example, from and between 40 psia to 20 psia, depending upon which flow controller is open. A pressure P2 between the piston 270 and the cylinder chamber end 274, i.e., the piston stop side of the piston, is determined by the pressure of the high pressure refrigerant supplied by the conduit 220. Pressure P2, in this example, ranges from 40 psia and above.

Regarding selection of components for the second flow controller 244, and with reference to the foregoing example, the low pressure refrigerant is at a pressure of 20 psia and the high pressure refrigerant is at a pressure of 40 psia. When the first flow controller 234 is open, pressure P1 will stabilize at 20 psia and pressure P2 will be at 40 psia and building. When there is a pressure difference between pressures P1 and P2 greater than 20 psia, the piston 270 exerts a force which causes the piston return spring 266 to compress. In this condition, there also is a magnetic coupling force between the second magnet 260B and the magnetic disk 272. The sum of the piston return spring force and the magnetic coupling force between the second magnet 260B and the disk 272 equals, and is opposite to, the force exerted by the piston 270 when the pressure difference is 20 psia. The selection of particular springs, piston size, and cylinder chamber size is based upon the foregoing desired operating characteristics. The particular selections, of course, vary depending upon the desired operating characteristics.

In the present example, the initial conditions are as follows: the first flow controller 234 is open; the second flow controller 244 is closed; the magnetic disk 272 is magnetically coupled to and in contact with the second magnet 260B; pressure P1 is equal to the pressure (20 psia) of the low pressure refrigerant; and pressure P2 is equal to the pressure (40 psia) of the high pressure refrigerant and is rising.

As pressure P2 builds and rises above 40 psia, the piston 270 begins moving towards the valve stem 252 thus causing the valve stem spring 268 to become loaded, i.e., a compression force. As the piston 270 continues to move towards the valve stem 252, the magnetic coupling force between the disk 272 and the second magnet 260B is overcome. The valve stem 252 then snaps towards the valve cover spring 246 thereby displacing the valve cover 24 from the valve seat contact 258, i.e., the second flow controller 244 opens. When the second flow controller 244 opens, the high pressure refrigerant flows from the conduit 220 to the conduit 232 by flowing between the valve cover 248 and the valve seat contact 258, and through the valve seat 256 and around the valve stem 252. The magnetic disk 272, at this time, is magnetically coupled to and in contact with the first magnet 260A.

The high pressure refrigerant now present in the conduit 232 causes the first flow controller 234 to close. Particularly, the high pressure refrigerant exerts more force against the first check valve 234 than the low pressure refrigerant. The ball 236 of the first check valve 234 therefore is forced into and held in the ball seat 238. The first flow controller 234 remains closed while the high pressure refrigerant flows from the conduit 220 to the conduit 232. Also, while the high refrigerant flows from the conduit 220 to the conduit 232, pressures P1 and P2 are substantially equal.

When the magnetic disk 272 is magnetically coupled to and in contact with the first magnet 260A, the piston return spring 266 biases the piston 270 towards the cylinder chamber end 274. The second check valve 282 allows refrigerant to exit the cylinder chamber 254 through the orifice 290 at a slow rate. For example, the orifice 290 of the orifice check valve 282 is sized, in one embodiment, so that it takes 0.9 seconds for the piston 270 to contact the piston stop 272 subsequent to the magnetic disk 272 having come into contact with the first magnet 260A.

As the piston 270 moves towards the piston stop 272, a tension force is placed on the valve stem spring 268. This tension force eventually overcomes the magnetic coupling between the first magnet 260A and the magnetic disk 272. When this coupling force is overcome, the valve stem 252 snaps towards the piston 270 thus causing the valve cover 248 to impact against the valve seat contact 258, i.e., the second flow controller 244 closes. The high pressure refrigerant will not be able to flow from the conduit 220 to the conduit 232 once the second flow controller 244 closes.

When the high pressure refrigerant discontinues flowing, the first flow controller 234 opens. Particularly, the low pressure refrigerant forces the first flow controller 234 open thereby allowing the low pressure refrigerant to flow from the conduit 230 to the conduit 232. At this time, the unit 218 is once against the initial condition and the process is repeated.

The refrigerant flow control unit 218 utilizes, in part, the pressure difference between the refrigerants to control refrigerant flow. The unit 218 is self-contained in that no outside energy source, e.g., electric power, is required to open and close the flow controllers. The embodiment illustrated in FIGS. 2B–C therefore is particularly useful as the refrigerant flow control unit when it is desired to eliminate a need for any outside energy source to control refrigerant flow.

If energy efficiency and cost are primary concerns, it is contemplated that for the system 200 illustrated in FIG. 2A the refrigerant flow control unit 218 is constructed as shown in detail in FIGS. 2B and 2C and the compressor unit 202 is a single stage compressor. By utilizing a plurality of evaporators selected to operate at desired, respective, refrigeration temperatures, improved energy use results. Further, by utilizing a single-stage compressor rather than a plurality of compressors or a compressor having a plurality of stages, increased costs associated with the improved energy efficiency are minimized.

The refrigeration system 200 illustrated in FIGS. 2A–C requires less energy compared to a single-evaporator, single-compressor circuit with the same cooling capacity. Some efficiency advantages come about due to the fact that the vapor leaving the higher temperature evaporator 208 is compressed from an intermediate pressure, rather than from the lower pressure of the vapor leaving the lower temperature evaporator 224. Since the vapor from the phase separator 210 is at a higher pressure than the vapor from the freezer evaporator 224, the pressure ratio is lower when vapor from the phase separator 210 is compressed to the desired compressor outlet pressure than when the vapor from the freezer evaporator 224 is compressed. Thus, less compression work is required than if all the refrigerant were also compressed from the freezer exit pressure.

Figure 3:
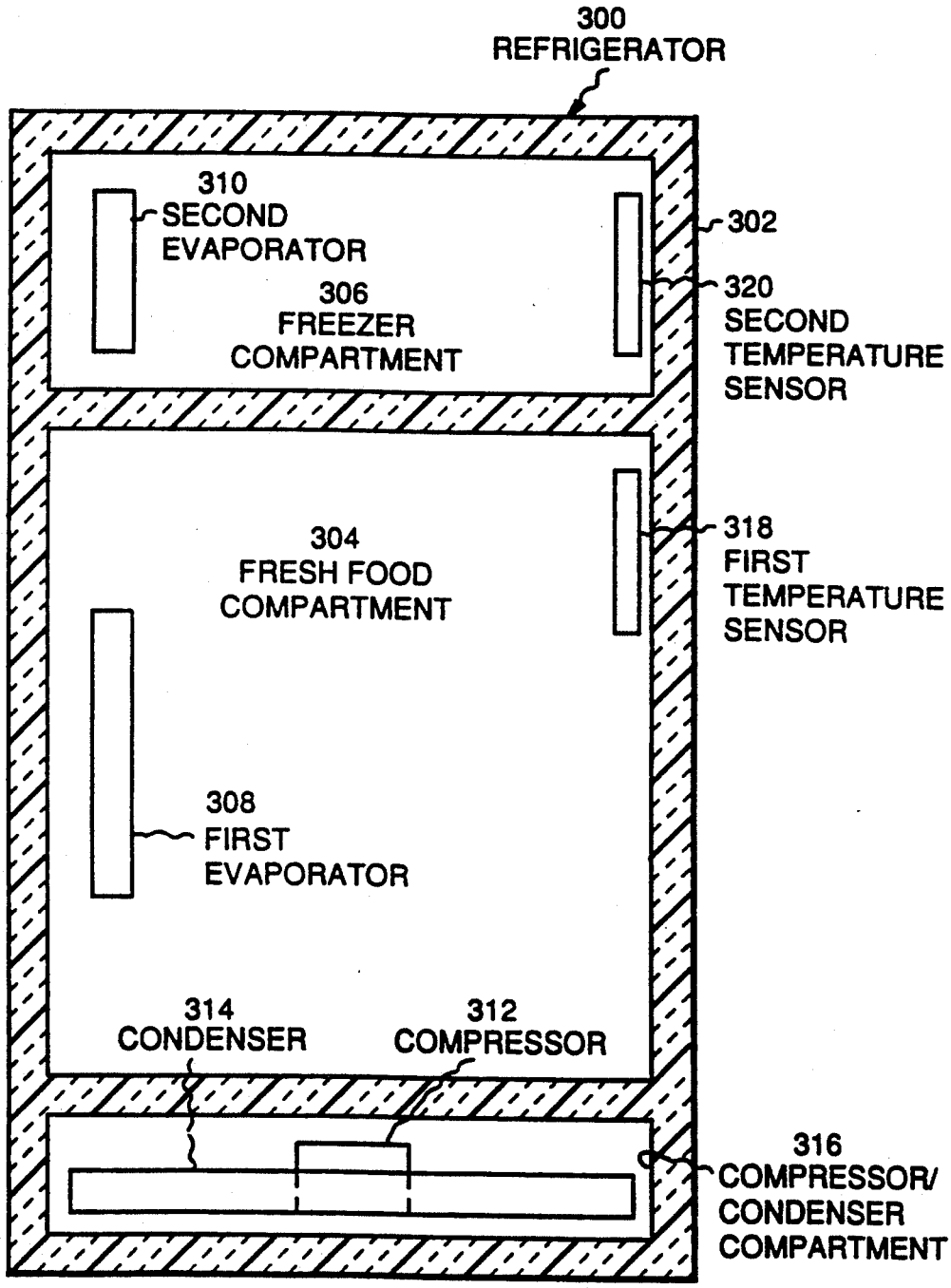
FIG. 3 is a block diagram illustration of a household refrigerator incorporating a refrigeration system with both a fresh food evaporator and a freezer evaporator.

FIG. 3 is a block diagram illustration of a household refrigerator 300 including an insulated wall 302 forming a fresh food compartment 304 and a freezer compartment 306. FIG. 3 is provided for illustrative purposes only, and particularly to show one apparatus which has substantially separate compartments which require refrigeration at different temperatures. In the household refrigerator, the fresh food compartment 304 and the freezer compartment 306 typically are maintained at about +33° F. to ×47° F. and −10° F. to +15° F., respectively.

In accordance with one embodiment of the present invention, a first evaporator 308 is shown disposed in the fresh food compartment 304 and a second evaporator 310 is shown disposed in the freezer compartment 306. The present invention is not limited to the physical location of the evaporators, and the location of the evaporators shown in FIG. 3 is only for illustrative purposes and to facilitate ease of understanding. It is contemplated that the evaporators 308 and 310 could be disposed anywhere in the household refrigerator, or even outside the refrigerator and the evaporator-cooled air from each respective evaporator is directed to the respective compartments via conduits, barriers, and the like.

The first and second evaporators 308 and 310 are driven by a compressor unit 312 and a condenser 314 shown located in a compressor/condenser compartment 316. A first temperature sensor 318 is disposed in the fresh food compartment 304 and a second temperature sensor 320 is disposed in the freezer compartment 306. The sensors 318 and 320 of course may be other types of sensors as hereinafter described. The first evaporator 308 typically is operated at between approximately +15° F. to approximately +32° F. and the second evaporator 310 typically is operated at approximately −30° F. to approximately 0° F. in order to maintain the fresh food compartment 304 at between approximately +33° F. to +47° F. and the freezer compartment 306 between approximately −10° F. to +15° F., respectively. Possible connections between these components are shown and explained with reference to FIGS. 2A and 6–9.

In operation, and by way of example, the first temperature sensor 318 and the second temperature sensor 320 are coupled to a refrigerant flow control unit (not shown in FIG. 3). When the temperature of the fresh food compartment 304 approaches +47° F., a signal from the first sensor 318 provides that the refrigerant flow control unit be configured to allow refrigerant flow through the first evaporator 308. Likewise, when the temperature of the freezer compartment 306 approaches +15° F., a signal from the second sensor 320 provides that the refrigerant flow control unit be configured to allow refrigerant flow through the second evaporator 310. A signal representative of a temperature differential between the temperatures sensed by the first and second temperature sensors 318 and 320 also could be utilized to control the particular configuration of the refrigerant flow control unit. An example of a refrigerator flow control unit which can be utilized with two respective temperature sensors is provided in FIG. 4A, which is hereinafter described i detail.

Typically, flow through the first evaporator 308 is initiated, or increased, before the fresh food compartment temperature reaches +47° F. and flow through the first evaporator 308 is stopped, or decreased, before the fresh food compartment temperature reaches +33° F. Likewise, flow through the second evaporator 310 is initiated, or increased, before the freezer compartment temperature reaches +15° F. and flow through the second evaporator 310 is stopped, or decreased, before the fresh food compartment temperature reaches −10° F.

The sensors 318 and 320, of course, preferably are user adjustable so that a system user selects a temperature, or temperature range, at which each respective evaporator is to be activated and/or inactivated. In this manner, operation of a refrigerant flow control unit is user adjustable.

As shown in FIG. 3, the illustrative refrigeration system includes a plurality of evaporators which are selected to operate at desired, respective, refrigeration temperatures. Reduced energy use is provided by utilizing a plurality of evaporators. Further, by utilizing, in one embodiment, a single-stage compressor as the compressor unit 312 rather than a plurality of compressors or a compressor having a plurality of stages, increased costs associated with the improved energy efficiency are minimized.

Figure 4A:
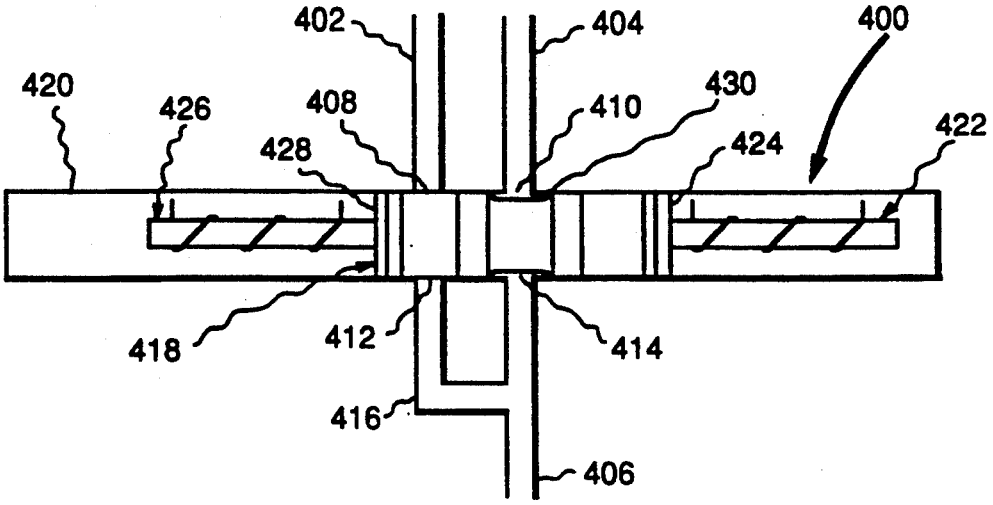
FIG. 4A shows a second embodiment of a refrigerant flow control unit.

FIG. 4A schematically illustrates a second embodiment 400 of a flow control unit. Particularly, the unit 400 includes two input conduits 402 and 404 and an output conduit 406. The input conduits 402 and 404 are coupled to inlet ports 408 and 410, respectively. Two outlet ports 412 and 414 and coupled together by a U-shaped conduit 416 which is shown as being integrally formed with the output conduit 406. A cylindrical spool 418 is slidably mounted in a housing 420. A first solenoid 422 is coupled to a first end 424 of the spool 418. A second solenoid 426 is coupled to a second end 428 of the spool 418.

In a first position, as shown in FIG. 4A, an annular groove 430 of the spool 418 causes the inlet 410, which receives refrigerant from the conduit 404, and the outlet 414 to be in flow communication with one another. Particularly, when the first solenoid 422 is actuated, it causes the spool 418 to be in a position so that the inlet 410 and the outlet 414 are in flow communication. When the power is cut-off to the first solenoid 322 and when power is supplied to the second solenoid 426, the spool 418 is moved to a second position (not shown). In the second position, the annular groove 430 provides that the inlet 408 is in flow communication with the outlet 412. Power eventually is cut-off to the second solenoid 426 and the first solenoid 422 is once again actuated so that the spool 418 returns to the first position and the process is repeated.

In operation, timing for the movement of the spool 418 is provided, for example, via sensors such as the first and second temperature sensors 318 and 320 shown in FIG. 3. In other contemplated embodiments, power is supplied to the respective solenoids, for example, by sensors for sensing the respective temperatures, pressures, densities, and/or flow rates of the respective refrigerants flowing in conduits 402 and 404. The number of inlet ports and respective outlet ports is determined by the specific context in which the unit 400 is to be used.

Figure 4B:
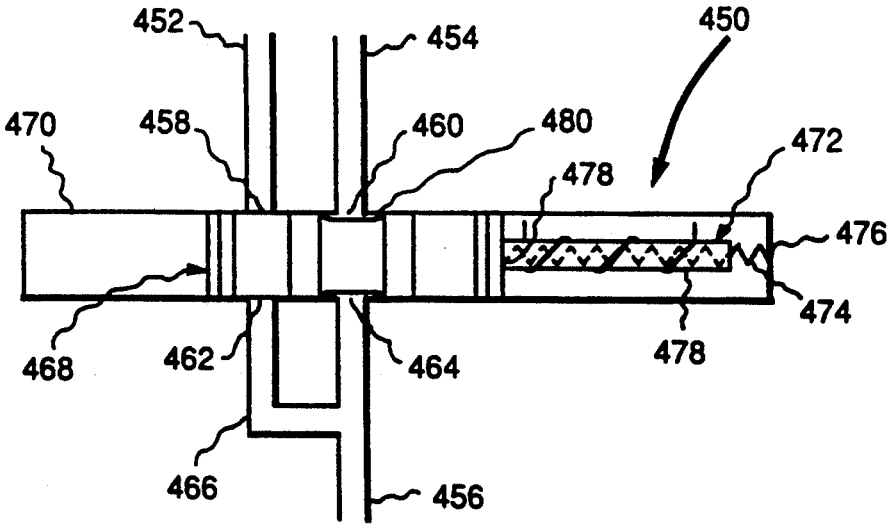
FIG. 4B shows a third embodiment of a refrigerant flow control unit.

FIG. 4B schematically illustrates a third embodiment 450 of a flow control unit. Particularly, the unit 450 includes two input conduits 452 and 454 and an output conduit 456. The input conduits 452 and 454 are coupled to inlet ports 458 and 460, respectively. Two outlet ports 462 and 464 are coupled together by a U-shaped conduit 466 which is shown as being integrally formed with the output conduit 456. A cylindrical spool 468 is slidably mounted in a housing 470. A solenoid 472 is coupled to the spool 468 and when actuated, moves the spool 468. A spring 474 is connected at one end 476 to the housing 470 and extends through the solenoid core 478. The spring 474 is connected at its other end 478 to the spool 468.

In a first position, as shown in FIG. 4B, an annular groove 480 of the spool 468 causes the inlet 460, which receives refrigerant from the conduit 454, and the outlet 464 to be in refrigerant flow communication with one another. Particularly, when the solenoid 472 is actuated, it moves the spool 468 to the right to be in the position shown in FIG. 4B so that the inlet 460 and the outlet 464 are in flow communication. In this first position, the spring 474 is compressed. When the power is cut-off to the solenoid 472, the spring 474 forces the spool 468 to the left into a second position (not shown). In the second position, the annular groove 480 provides that the inlet 458 is in flow communication with the outlet 462. When the solenoid 472 once again is actuated, the spool 468 returns to the first position and the process is repeated.

In operation, timing of the movement of the spool 468 is provided, in one embodiment, via an electrically-powered timer (not shown) coupled to the solenoid 472. Timed power output from the timer to the solenoid 472 is determined, for example, by the respective temperatures, pressures, densities, and/or flow rates of the respective refrigerants flowing, for example, in the conduits 452 and 454. The number of inlet ports and respective outlet ports is determined by the specific context in which the unit 450 is to be used.

Figure 5:
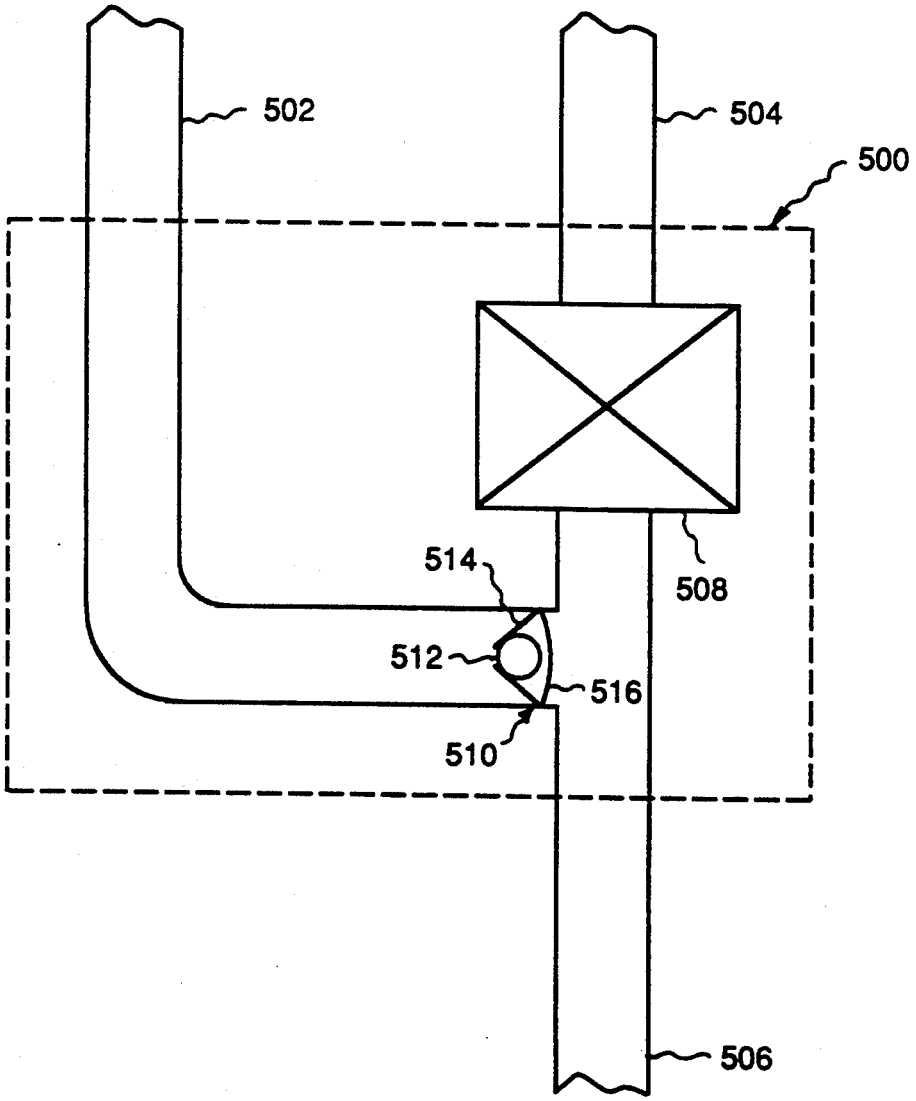
FIG. 5 shows a fourth embodiment of a refrigerant flow control unit.

A fourth embodiment 500 of a flow control unit is schematically shown in FIG. 5. Two input conduits 502 and 504 are integrally formed with the control unit 500. An output conduit 506 also is shown integrally formed with the control unit 500. The input conduits 502 and 504 and the output conduit 506, rather than being integrally formed with the unit 500, in another embodiment (not shown) are coupled to inlets and an outlet, respectively, of the unit 500 such as by welding, soldering, mechanical couplers, etc. The control unit 500 includes a controllable valve 508 which comprises a solenoid operated valve. A solenoid controlled valve with a timer is available, for example, from ISI Fluid Power Inc., Fraser, Mich. The valve from ISI Fluid Power Inc. is modified by removing the housing gaskets and hermetically sealing the housing for use with refrigerants. The controllable valve 508 is used for controlling fluid flow through the input conduit 504 which typically carries a higher pressure refrigerant than the conduit 502. A check valve 510 is disposed within the input conduit 502. The check valve 510 includes a ball 512, a seat 514, and a cage 516.

In operation, timing for the opening and closing of the controllable valve 508 is provided via an electrically-powered timer (not shown). Timed power output from the timer to the solenoid of the controllable valve 508 is determined, for example, by the respective temperatures, pressures, densities, and/or flow rates of the respective refrigerants. When the valve 508 allows refrigerant to flow therethrough, the high pressure refrigerant causes the check valve 510 to close and remain closed while the high pressure refrigerant is flowing. When the valve 508 is closed, the low pressure refrigerant in the conduit 502 forces the check valve 510 open and the low pressure refrigerant flows from the conduit 502 to the output conduit 506.

Although the flow control units illustrated show two input conduits for supplying input refrigerant to the control unit, the number of input conduits for each system may vary. For example, in other embodiments, it is contemplated that three or more input conduits are utilized to supply refrigerant to the refrigerant flow control units.

FIGS. 2B–C, 4A–B and 5 illustrate specific embodiments of refrigerant flow control units. Many other mechanisms can be used to control refrigerant flow in accordance with the present invention. The specific unit selected depends upon the specific context in which the unit is to be used.

Figure 6:
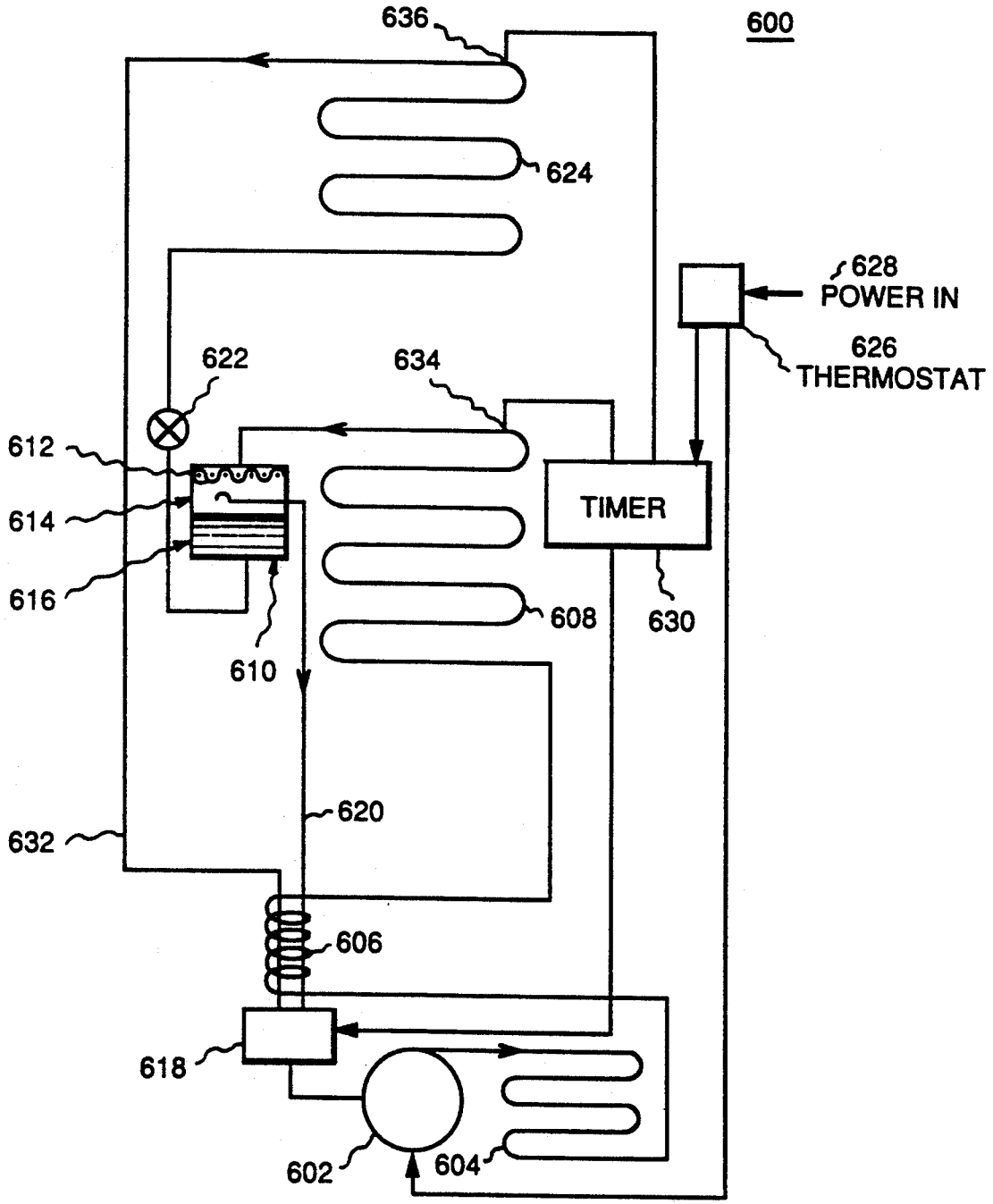
FIG. 6 illustrates a second embodiment of a refrigeration system.

A second embodiment 600 of a refrigeration system is shown in FIG. 6. Many of the components of the system 600 correspond to components of refrigeration system embodiment 200 illustrated in FIG. 2. Particularly, the embodiment 600 includes a compressor unit 602 coupled to the inlet of a condenser 604. The inlet of a capillary tube 606 is coupled to the outlet of the condenser 604, and the inlet of a first evaporator 608 is coupled to the outlet of the capillary tube 606. The outlet of the first evaporator 608 is coupled to the inlet of a phase separator 610. The phase separator 610 includes a screen 612 disposed adjacent the phase separator inlet, a vapor portion 614 and a liquid portion 616. The phase separator vapor portion 614 is coupled, as a first input, to a refrigerant flow control unit 618. Particularly, a conduit 620 extends from the phase separator vapor portion 614 to the control unit 618. The portion of the conduit 620 within the phase separator 610 is arranged so that liquid refrigerant entering the phase separator vapor portion 614 passes through the vapor portion 614 and cannot enter the open end of the conduit 620. The outlet of the phase separator liquid portion 616 is coupled to an expansion device 622. The inlet of a second evaporator 624 is coupled to the outlet of the expansion device 622, and the outlet of the second evaporator 624 is coupled, as a second input, to the refrigerant flow control unit 618.

The outlet of the refrigerant flow control unit 618 is coupled to the compressor unit 602. The refrigerant flow control unit 618 and the compressor unit 602, by way of example, could be any of the corresponding units hereinbefore described with reference to FIGS. 1–5. A thermostat 626, which receives current flow from an external power source designated by the legend "POWER IN" 628, is connected to the compressor unit 602 and to a timer 630. The timer 630 controls operation of the control unit 618. In this embodiment also, the timer 630 is not directly connected to the compressor unit 602. When cooling is required, the thermostat output signal provides for activation of the compressor unit 602 and the timer 630. The compressor unit 602 operates only when the thermostat 626 indicates a need for cooling. The configuration of the control unit 618 at any particular time dictates refrigerant flow through the respective evaporators as hereinbefore described.

The timer 630 is a fixed timer or a variable timer. For the embodiment shown in FIG. 6, the timer 630 is a variable timer, which means that the timer 630 controls the control unit 618 to have a variable duty cycle. Duty cycle, as used herein, refers to the ratio of time the control unit 618 is in a particular state, i.e., configuration, to the total time (normalized to one) the control unit 618 is controlled by the timer 630. If the duty cycle for STATE 2 is D, then the duty cycle for STATE 1 is 1-D. In an exemplification duty cycle, the control unit 618 is in STATE 1 two thirds of the time and in STATE 2 one third of the time, for example. In the exemplification cycle, the total time of each time period is between four and thirty seconds. During a six second period, for example, the control unit 618 is in STATE 1 for four seconds and in STATE 2 for two seconds. With the embodiment of FIG. 6, and using refrigerant R-12 (dichlorodifluoromethane), typically refrigerant at 20 psia is disposed in the conduit 632 and refrigerant at 40 psia is disposed in the conduit 620. More particularly, the pressure range for the first evaporator 608 typically is 40 psia to 44 psia and the temperature range for the first evaporator 608 typically is +26° F. to +31° F. The pressure range for the second evaporator 624 typically is 18.5 psia to 21 psia and the temperature range for the second evaporator typically is −12° F. to −6° F. The inlet pressure to the compressor unit 602 when the control unit 618 is in STATE 1 is approximately 20 psia. When the control unit 618 is in STATE 2, the compressor unit inlet pressure is approximately 40 psia. Refrigerants other than R-12, of course, may be used.

The duty cycle determines the pressure ratio of the compressor unit 602 when compressing the refrigerants. The duty cycle to be used is determined by a number of factors, including relative load, the type of refrigerant used and the temperatures at which the first and second evaporators 608 and 624 are to operate, for example. The duty cycle is determined by the amount of cooling capacity the system requires at each of the two temperature levels, which determines the mass flow rate of the refrigerant through the compressor unit 602 when the control unit 618 is in each of its two states.

As an example, and using refrigerant R-12, assume that it is desired that the ratio of the freezer evaporator cooling capacity $Q_{fz}$ to the total cooling capacity $Q_T$ of the refrigeration system is 0.5 i.e., $Q_{fz}/Q_T=0.5$. Assume also that the compressor unit 602 spends 0.63 time units pulling refrigerant from the freezer evaporator 624 and 0.37 time units pulling refrigerant from the fresh food evaporator 608. Under these conditions, the mass flow rate through the freezer evaporator 624 is 8.2 lb(m)/hr (lb(m) means pounds in terms of mass as opposed to pounds in terms of force) and the mass flow rate through the fresh food evaporator 608 is 11.1 lb(m)/hr. The mass flow rate through the condenser 604, of course, is the sum of the respective mass flow rates through the evaporators, i.e., 19.3 lb(m)/hr. The above mass flow rates are time averaged. The cooling capacity of the freezer evaporator 624 in these conditions is 507.5 BTU/hr and the cooling capacity of the fresh food evaporator 608 is 500.9 BTU/hr. The cooling capacity, of course, depends upon the particular size of the evaporators. The above cooling capacities are time averaged. The time-averaged power input to the compressor unit 602 when pulling refrigerant from the freezer evaporator 624 is 335.2 BTU/hr and when pulling refrigerant from the fresh food evaporator 608 is 250.8 BTU/hr. It should be understood, of course, that the above figures are provided only for exemplification purposes to facilitate an understanding of the cooling capacity, mass flow rate, and duty cycle relationship. Actual calculations, of course, depend upon physical characteristics of the areas to be refrigerated, specific components utilized, along with other well known principles of thermodynamics.

First and second sensors 634 and 636, which preferably are user adjustable, are coupled to the timer 630. The sensors 634 and 636 are pressure, temperature, density, or flow rate sensors, for example, so as to sense a physical attribute of the refrigerant in each of the evaporators 608 and 624 or a physical attribute of the refrigeration system. The term "physical attribute" as used herein refers to a measurable property, operating parameter, or the like of the refrigerant and/or refrigerating system. Further, in other embodiments, a pressure differential or temperature differential signal is generated by comparing signals from respective pressure or temperature sensors. The pressure or temperature differential signal likewise is used to control refrigerant flow. Respective pressure sensors, for example, are connected anywhere along the length of the evaporators such as at the outlet of an evaporator. Respective temperature sensors preferably are placed at a location along the length of respective evaporators where two-phase refrigerant flows. Two-phase refrigerant refers to refrigerant composed of a substantial amount of vapor refrigerant and a substantial amount of liquid refrigerant. For example, two-phase refrigerant typically flows through the entire length of the first fresh food evaporator 608 and two-phase refrigerant typically flows from the inlet to approximately the midpoint of the second freezer evaporator 624. The output signals from the respective sensors are used, for example, to vary the duty cycle of control unit 618.

If the sensors 634 and 636 are temperature sensors, a range of operating temperature is established, for example, through experimentation. It is contemplated, of course, that both the sensors 634 and 636 are not necessary for every configuration. For example, in one embodiment, the sensor 634 is used and the sensor 636 is not used. The variable timer 630, for example, is used to control the control unit duty cycle so that the control unit 618 is in STATE 2 during most of each period when predetermined conditions exist, e.g., when the temperature sensed by the sensor 634 is high. Operating the control unit 618 in this manner results in the compressor unit 602 compressing, for a longer period, vapor from the phase separator 610. The variable timer 630, for example, adjusts the control unit duty cycle so that the control unit 618 is in STATE 1 during most of each period when other predetermined conditions exist, e.g., when the temperature sensed by the sensor 634 is low. A temperature detected within the range results in a duty cycle proportional to the distance between the high and low portions of the range so that a temperature at the center of the range provides a 50% duty cycle with the control unit 618 being in each state approximately half of each period.

Similarly, if a pressure sensor is used, a range including upper and lower pressures is established, for example, through experimentation. For example, when a high pressure at the high end of the range or above is sensed at the outlet of the first evaporator 608, the variable timer 630 then adjusts the control unit duty cycle so that the control unit 618 is in STATE 2 during most of each period. When a low pressure at the low end of the range or below is sensed at the outlet of the first evaporator 608, the variable timer 630 then adjusts the control unit duty cycle so that the control unit is in STATE 1 during most of each period.

Ranges for signals output from a flow rate sensor or a density sensor are established through experimentation and such ranges are used in a manner similar to the temperature or pressure output signal ranges discussed above. Further, it is contemplated that a temperature difference representative signal obtained by taking the difference of signals representative of the temperature of the respective compartments also can be used. A range is determined through experimentation for the temperature difference representative signal. Similarly, a pressure difference representative signal can also be utilized. By way of example, if a period of 10 seconds is used, then a duty cycle of 1 second in one state and 9 seconds in the other state is used at the extreme ends of the range.

A variable timer is not used to control the refrigerant flow control unit 218 shown in FIGS. 2B–C because that control unit 219 operates on the pressure differences of refrigerant pressures and spring forces, i.e., no externally generated signals are utilized. A variable timer can be used to drive the refrigerant flow control units shown in FIGS. 4A–B and 5. Thermostat 628, of course, is used to activate the compressor unit 602 with any of the refrigerant flow control units illustrated in FIGS. 2B–C, 4A–B, and 5.

If the timer 630 is a fixed timer, this means that the timer 630 has a fixed duty cycle which is predetermined and does not vary. The sensors 634 and 636 are not utilized when the timer 630 has a fixed duty cycle.

Figure 7:
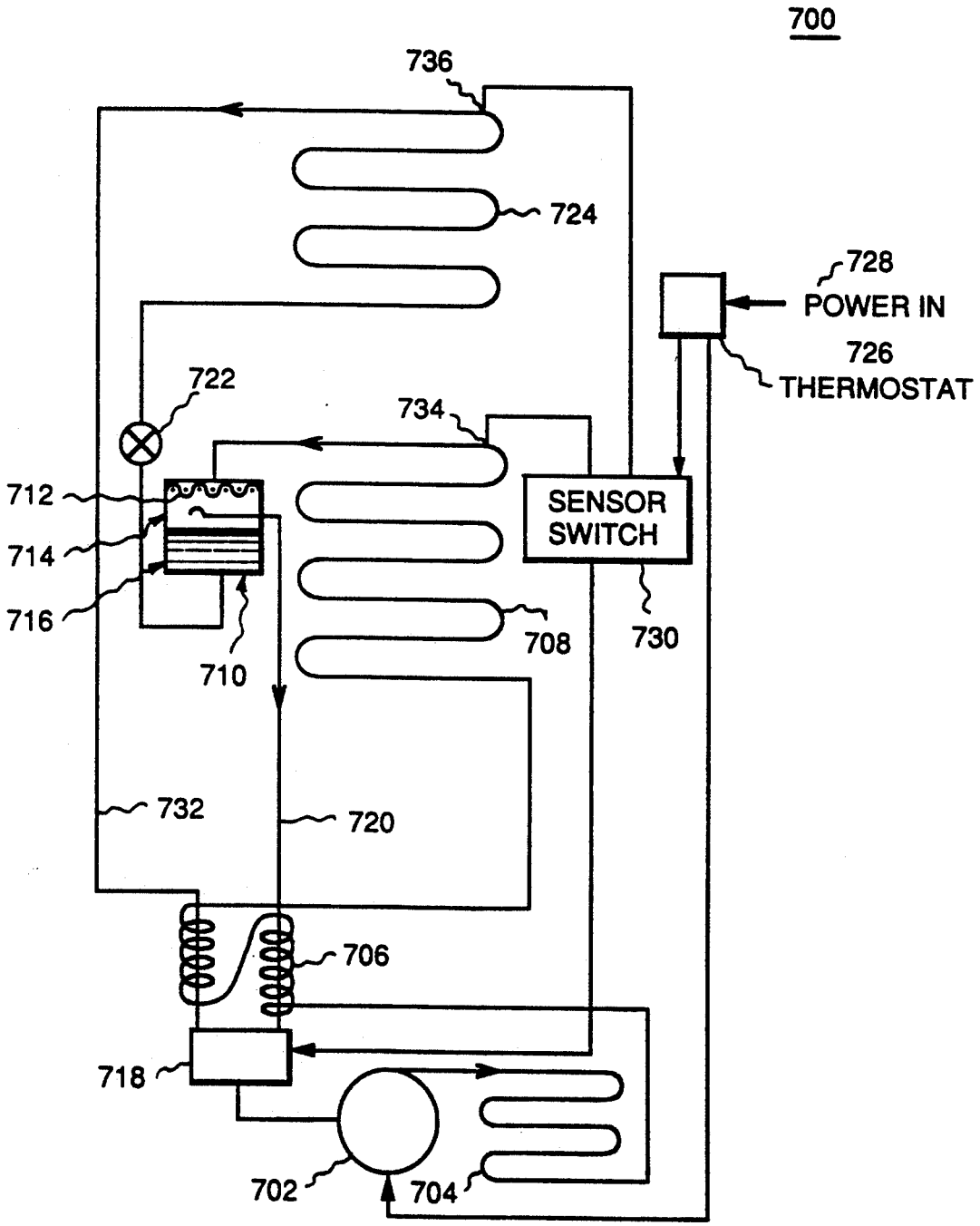
FIG. 7 illustrates a third embodiment of a refrigeration system.

A third embodiment 700 of a refrigeration system is shown in FIG. 7. Many of the components of the system 700 correspond to components illustrated in FIGS. 2A and 6. Particularly, embodiment 700 includes a compressor unit 702 coupled to the inlet of a condenser 704. The inlet of a capillary tube 706 is coupled to the outlet of the condenser 704, and the inlet of a first evaporator 708 is coupled to the outlet of the capillary tube 706. The outlet of the first evaporator 708 is coupled to the inlet of a phase separator 710. The phase separator 710 includes a screen 712 disposed adjacent the phase separator inlet, a vapor portion 714 and a liquid portion 716. The phase separator vapor portion 714 is coupled, as a first input, to a refrigerant flow control unit 718. Particularly, a conduit 720 extends from the phase separator vapor portion 714 to the control unit 718. The portion of the conduit 720 within the phase separator 710 is arranged so that liquid refrigerant entering the phase separator vapor portion 714 passes through the vapor portion 714 and cannot enter the open end of the conduit 720. The outlet of the phase separator liquid portion 716 is coupled to an expansion device 722. The inlet of a second evaporator 724 is coupled to the outlet of the expansion device 722, and the outlet of the second evaporator 724 is coupled, as a second input, to the refrigerant flow control unit 718.

The outlet of the refrigerant flow control unit 718 is coupled to the compressor unit 702. A thermostat 726 is connected to the compressor unit 702 and receives input from a power source designated by the legend "POWER IN" 728. The thermostat 726 also is coupled to a sensor switch 730. The output of the sensor switch 730 is connected to the control unit 718, and the switch 730 controls operation of the control unit 718. In this embodiment also, the sensor switch 730 is not directly connected to the compressor unit 702. The sensor switch 730, for example, is not used to control the refrigerant flow control unit shown in FIGS. 2B–C but can be used to drive the refrigerant flow control units shown in FIGS. 4A–B and 5. The thermostat 726, of course, is used to control the compressor unit 702 coupled to any of the refrigerant flow control units.

The conduits 720 and 732 are not soldered together. Rather, the capillary tube 706 is in a counterflow heat exchange relationship with the conduit 720 and in a counterflow heat exchanger relationship with the conduit 732. The sequential heat exchange relationship between the capillary tube 706 and the conduits 720 and 732 in FIG. 7 differs from the simultaneous heat exchange relationship between the capillary tube 606 and the conduits 620 and 632 in FIG. 6. Particularly, in FIG. 7, the refrigerant flowing in the capillary tube 706 first undergoes a counterflow heat exchange with refrigerant in the conduit 720 and then undergoes a counterflow heat exchange with refrigerant in the conduit 732. This sequential heat exchange results in reducing the temperature of refrigerant flowing through the capillary tube 706 more than the simultaneous heat exchange which occurs in the capillary tube 606 in FIG. 6. Therefore, the sequential heat exchange shown in FIG. 7 is believed to be a more efficient heat transfer arrangement.

First and second sensors 734 and 736 are coupled to the sensor switch 730. The sensors 734 and 736 are, for example, temperature, pressure, flow rate or density sensors. Receptive pressure sensors, for example, are connected anywhere along the length of the evaporators 708 and 724 such as at respective evaporator outlets. Respective temperature sensors preferably are placed at a location along the length of respective evaporators where two-phase refrigerant flows. The sensor switch 730 is configured to control the control unit 718 so that the unit 718 is in an appropriate configuration, i.e., state, when certain predetermined conditions occur. For example, if the pressure at the first evaporator 708 is above 44 psia, the sensor switch 730 causes the control unit 718 to be in STATE 2 to establish increased refrigeration flow through the first evaporator 708. In this example, the sensor 736 is not needed. Similarly, and using the sensor 736 in another embodiment, if the pressure at the second evaporator 724 is above 21 psia, the sensor switch 730 causes the control unit 718 to be in STATE 1 to establish increased refrigerant flow through the second evaporator 724. In this example, the sensor 734 is not needed. The sensors 734 and 736 and the sensor switch 730 preferably are user adjustable.

Figure 8:
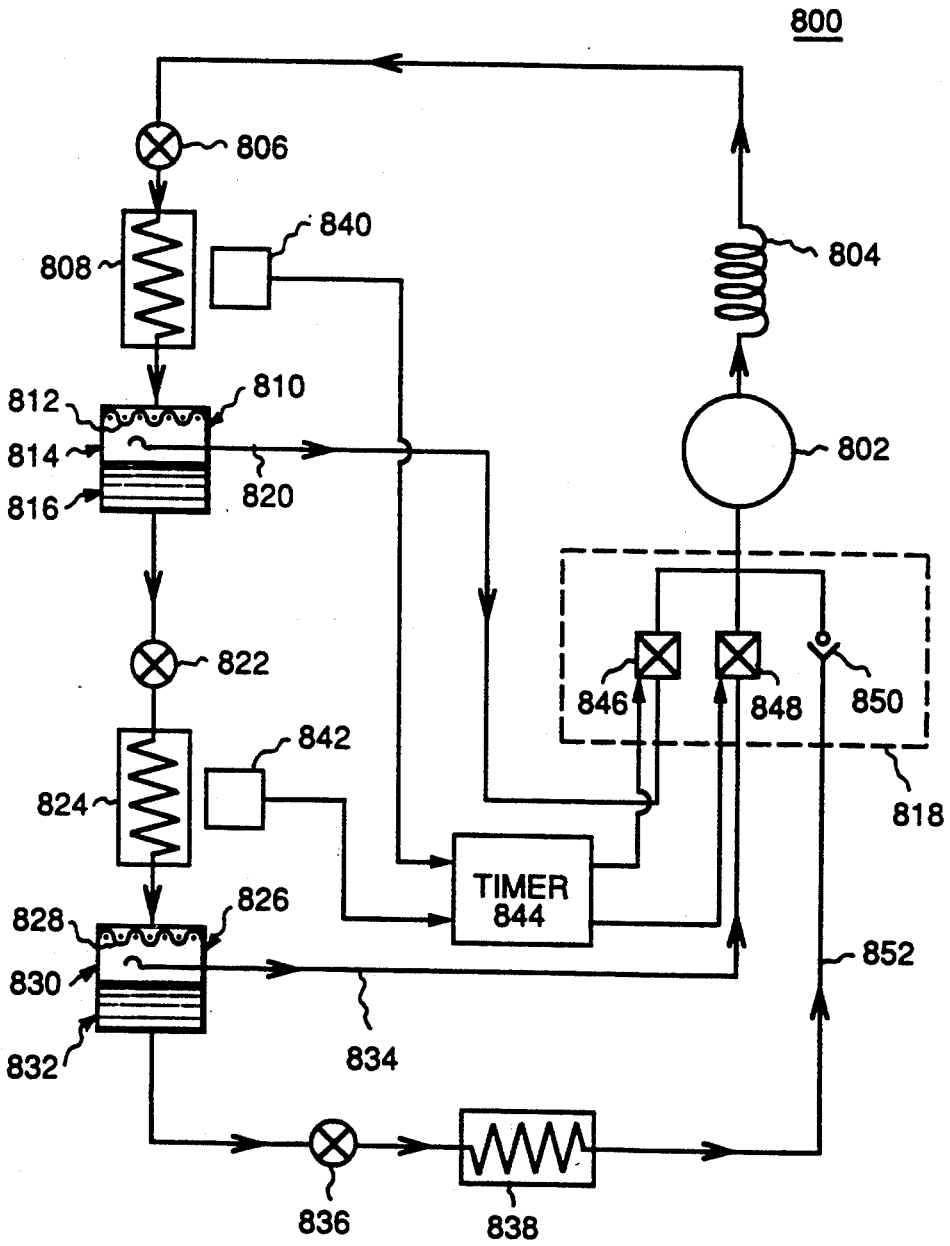
FIG. 8 illustrates a fourth embodiment of a refrigeration system.

FIG. 8 illustrates one embodiment of the present invention wherein more than two evaporators are utilized. More than two evaporators provide even further efficiencies in some contexts. For example, in some contexts, it is desired to provide a household refrigerator with a third evaporator to quickly chill or freeze selected items in a separate compartment. The third embodiment 800 incorporates many components corresponding to components illustrated in FIGS. 2A, 6 and 7. Particularly, embodiment 800 includes a compressor unit 802 coupled to a condenser 804. The outlet of the condenser 804 is coupled to a first expansion valve 807 which has its outlet coupled to a first evaporator 808. The outlet of the first evaporator 808 is coupled to the inlet of a first phase separator 810. The first phase separator 810 includes a screen 812, a vapor portion 814 and a liquid portion 816. The phase separator vapor portion 814 is coupled, as a first input, to a refrigerant flow control unit 818. Particularly, a conduit 820 extends from the first phase separator vapor portion 814 to the control 818 and the conduit 820 is arranged within the phase separator 810 so that liquid refrigerant entering the phase separator vapor portion 814 passes through the vapor portion 814 and cannot enter the open end of the conduit 820. The outlet of the first phase separator liquid portion 816 is coupled to a second expansion valve 822. A second evaporator 824 is coupled to the outlet of the second expansion valve 822, and the outlet of the second evaporator 824 is coupled to the inlet of a second phase separator 826. The second phase separator 826 includes a screen 828, a vapor portion 830 and a liquid portion 832. The phase separator vapor portion 830 is coupled, as a second input, to the refrigerant flow control unit 818. Particularly, a conduit 834 extends from the second phase separator vapor portion 830 to the control unit 818 and the conduit 834 is arranged within the phase separator 826 so that liquid refrigerant entering the phase separator vapor portion 830 passes through the vapor portion 830 and cannot enter the open end of the conduit 834. The outlet of the second phase separator liquid portion 832 is coupled to a third expansion valve 836. A third evaporator 838 is coupled to the outlet of the third expansion valve 836, and the outlet of the third evaporator 838 is coupled, as a third input, to the refrigerant flow control unit 818.

First and second sensors 840 and 842 for example, are utilized for detecting physical attributes of the first and second evaporators 808 and 824, respectively, or to detect physical attributes of refrigerant flowing through the respective evaporators. For example, the sensors 840 and 842 are temperature, pressure, flow rate, and/or density-type sensors. Respective pressure sensors, for example, are connected anywhere along the length of the evaporators 808 and 824 such as at respective evaporator outlets. Respective temperature sensors preferably are placed at a location along the length of respective evaporators where two-phase refrigerant flows. The first and second sensors 840 and 842 are coupled to a timer 844. The timer 944 is a variable timer. Rather than the timer 844, a sensor switch can be utilized. Also, in another embodiment, a fixed timer can be used to drive the control unit 818. With the fixed timer embodiment, of course, the sensors 840 and 842 are not necessary. The sensors 840 and 842 preferably are user adjustable.

The control unit 818 shown in FIG. 8 comprises first and second controllable valves 846 and 848. Particularly, the valves 846 and 848 preferably are on-off solenoid valves which are well-known in the art. The control unit 818 further comprises a check valve 850. The first and second controllable valves 846 and 848 receive, as inputs, refrigerant flowing through the conduits 820 and 834, respectively. The conduit 852, which is coupled to the third evaporator, provides input refrigerant to the check valve 850.

In operation, each valve of the control unit 818 alternately opens to allow refrigerant to flow through the respective evaporators to the compressor unit 802. For example, when the first valve 846 is open and the valve 848 is closed, refrigerant flows through the first evaporator 808 to the phase separator 810 and to the compressor unit 802 via the conduit 820. Refrigerant does not flow through the second or third evaporators 824 and 838 at this time.

Similarly, when the first valve 846 is closed and the second valve 848 is open, refrigerant flows from the liquid portion 816 of the phase separator 810, through the expansion device 822, through the second evaporator 824, to the phase separator 826, and to the compressor unit 802 via the conduit 834. Vapor refrigerant does not flow from the first phase separator 810 or from the third evaporator 838 to the compressor unit 802 at this time. Refrigerant flows through the first evaporator 808 from the condenser 804 at this time.

When both the valves 846 and 848 are closed, the third valve 850 automatically opens and liquid refrigerant flows from the second phase separator liquid portion 832, through the expansion device 836, though the third evaporator 838, and to the compressor unit 802. Refrigerant also flows through the first evaporator 808 and the second evaporator 824 at this time.

Relative to each other, a higher pressure refrigerant flows through the conduit 820, a medium pressure refrigerant flows through the conduit 834, and a lower pressure refrigerant flows through the conduit 850. The timer 844 controls the duty cycle of the control unit 818. The specific duty cycle selected depends, of course, upon the desired operating parameters of each evaporator. It will be understood that the timer 844 controls the valves 846 and 848 so that they open alternately or are both closed, but they are not concurrently open. A thermostat (not shown), of course normally will be provided to control activation of the compressor unit 802.

Figure 9:
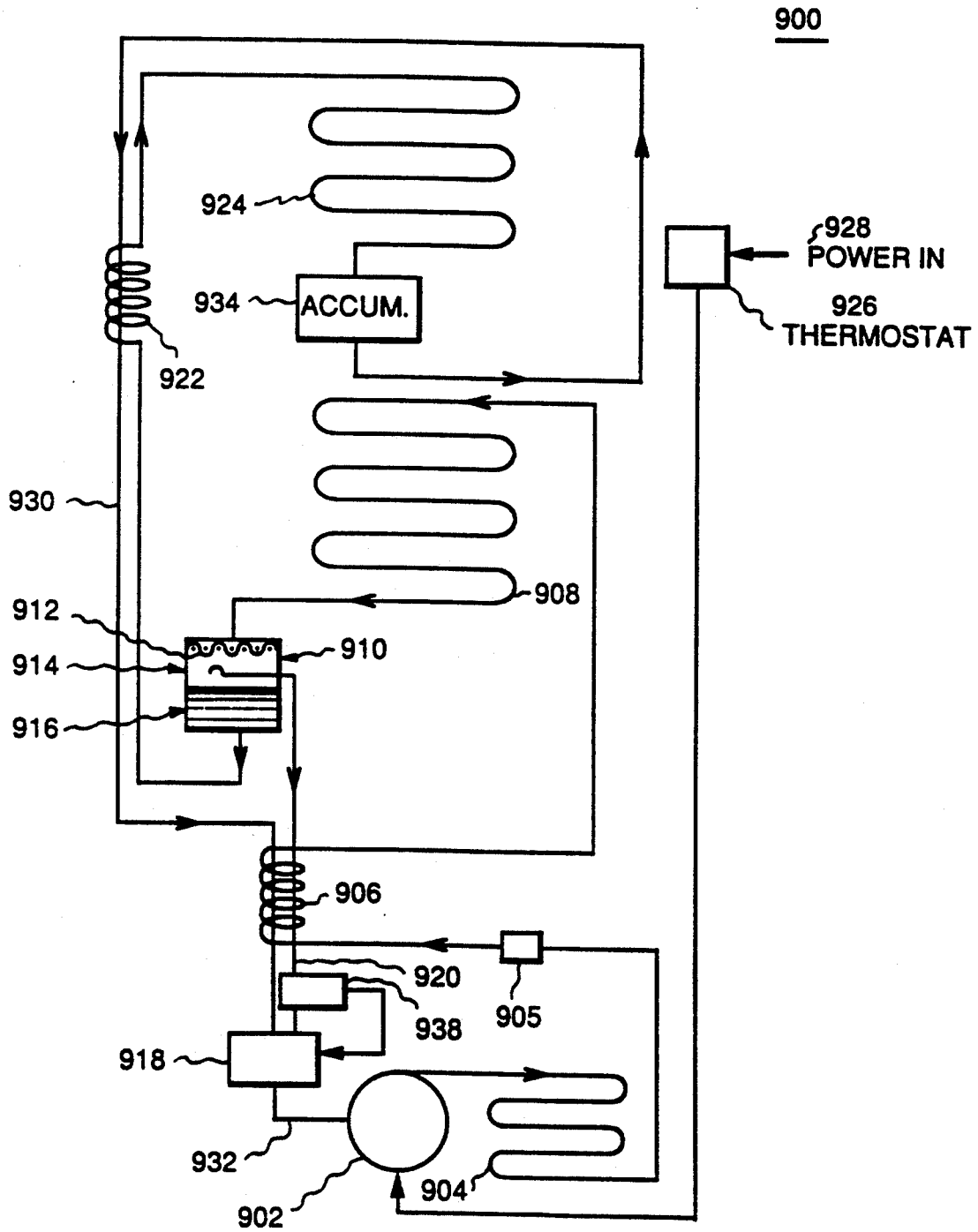
FIG. 9 illustrates a fifth embodiment of a refrigeration system.

A fifth embodiment 900 of a refrigeration system is shown in FIG. 9. Most of the components of the system 900 correspond to the components of embodiment 200 illustrated in FIG. 2A. It is believed that the system shown in FIG. 9 is very efficient in terms of energy use. Particularly, the embodiment 900 includes a compressor unit 902 coupled to a condenser 904. A first capillary tube 906 is coupled to the outlet of the condenser 904. Preferably, a filter/dryer 905, known in the art as a "pickle", is disposed in the refrigerant flow path between the condenser 904 and the capillary tube 906. The pickle 905 filters out particulates from the refrigerant and absorbs moisture. A first evaporator 908 is shown coupled to the outlet of the first capillary tube 906. The outlet of the first evaporator 908 is coupled to the inlet of a phase separator 910. The phase separator 910 includes a screen 912 disposed adjacent the phase separator inlet, a vapor portion 914 and a liquid portion 916. The phase separator vapor portion 914 is coupled, as a first input, to a refrigerant flow control unit 918. The control unit 918 preferably is the control unit shown in FIG. 5. A conduit 920 extends from the phase separator vapor portion 914 to the control unit 918 and the conduit 920 is arranged within the phase separator 910 so that liquid refrigerant entering the phase separator vapor portion 914 passes through the vapor portion 914 and cannot enter the open end of the conduit 920. The outlet of the phase separator liquid portion 916 is coupled to a second capillary tube 922. A second evaporator 924 is coupled to the outlet of the second capillary tube 922, and the outlet of the second evaporator 924 is coupled, as a second input, to the refrigerant flow control unit 918.

The outlet of the refrigerant flow control unit 918 is coupled to the compressor unit 902. A thermostat 926, which receives current flow from an external power source designated by the legend "POWER IN" 928, is connected to the compressor unit 902. When cooling is required, the thermostat output signal provides for activation of the compressor unit 902. The thermostat 926 typically is disposed in the freezer compartment of the refrigerator. The compressor unit 902 operates only when the thermostat 926 indicates a need for cooling. The configuration of the control unit 918 dictates refrigerant flow through the respective evaporators as hereinbefore described.

The evaporators 908 and 924 shown in FIG. 9 preferably are spine fin evaporators which are well known in the art and the compressor unit 902 preferably is a rotary type compressor. The evaporators 908 and 924, for example, are disposed in the fresh food compartment and the freezer compartment, respectively, of a household refrigerator. The evaporators 908 and 924 preferably are positioned so that gravity forces drain any excess liquid refrigerant out of the evaporators.

The second capillary tube 922 is disposed in a counterflow heat exchange arrangement with the conduit 930. The heat exchange arrangement of the capillary tube 922 and the conduit 930 is one embodiment of the invention which is the subject matter of U.S. Pat. No. 5,157,943. The first capillary tube 906 is disposed in a counterflow heat exchange arrangement with the conduits 920 and 930.

Figure 10:
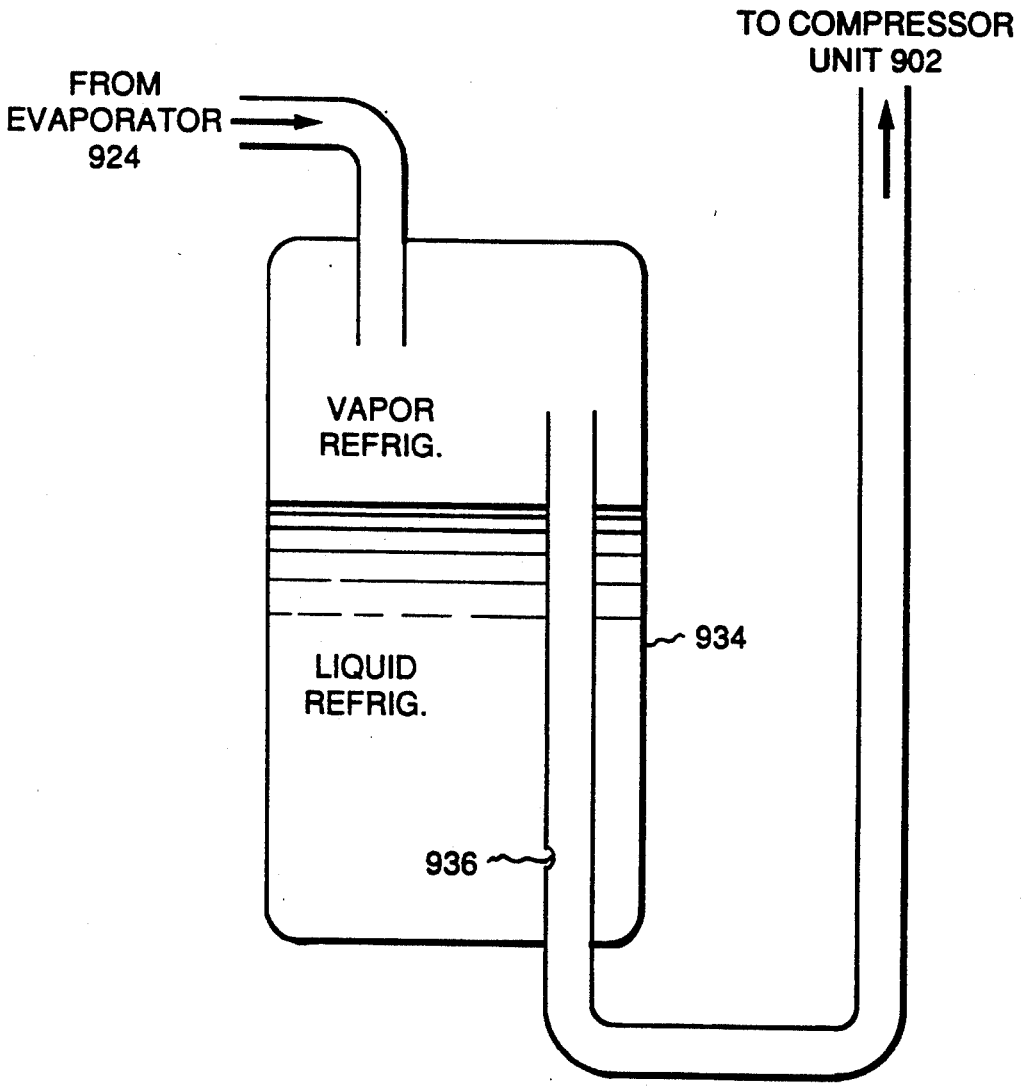
FIG. 10 illustrates, in more detail, the accumulator used in the embodiment of the refrigeration system illustrated in FIG. 9.

In addition to the above components, the system 900 includes an accumulator 934. The accumulator 934 is disposed at the exit of the second evaporator 924 and within the freezer compartment. A more detailed view of the accumulator 934 is shown in FIG. 10. Referring now to FIG. 10, the accumulator 934 receives refrigerant discharged from the second evaporator 924 and supplies vapor refrigerant to the compressor unit 902, via the control unit 918. An internal transport line bleeder hole 936 is provided to prevent lubricant hold-up when cycle conditions change, e.g., when superheated vapor is discharged from the second evaporator 924 as hereinafter explained.

When the second evaporator 924 operates at lower than specification temperatures, such as due to decreased thermal load or due to compartment thermostat setting for example, some liquid is discharged from the second evaporator 924. The accumulator 934 prevents a loss of cooling capacity which would result from evaporation in the conduit 930 of liquid discharged from the second evaporator 924. Particularly, liquid discharged from the second evaporator 924 is stored in the accumulator 934. Vapor discharged from the second evaporator 924 passes through the conduit 930. When refrigerant flowing from the second evaporator 924 is superheated, then the refrigerant liquid stored within the accumulator 934 is evaporated in the accumulator 934 and passes through the conduit 930. In this manner, the accumulator 934 facilitates preventing a loss of the cooling capacity of the second evaporator 924.

In FIG. 9, a pressure sensor 938 is disposed in a position to generate a signal representative of the pressure of refrigerant flowing the conduit 920 and between the capillary tube 906 and the conduit 920 heat exchange arrangement and the control unit 918. The output signal from the pressure sensor 938 is used to control operation of the control unit 918.

More particularly, in operation and using, for example, the refrigerant R-12 (dichlorodifluoromethane), refrigerant at about 20 psia is disposed in the conduit 930 and refrigerant at about 40 psia is disposed in the conduit 920. The inlet pressure to the compressor unit 902 when the control unit 918 is in STATE 1 is approximately 20 psia. When the control unit 918 is in STATE 2, the compressor unit inlet pressure is approximately 40 psia. The pressure switch 938 is used to control the particular state or configuration of the control unit 918. For example, if it is preferred to maintain the refrigerant in the first evaporator 908 at approximately +34° F., a temperature range of approximately +26° F. to +36° F. is a suitable range for the temperature of the refrigerant in the first evaporator 908. By sensing the pressure of the refrigerant in the conduit 920 close to the flow control unit 918, as illustrated by the location of the pressure sensor 938 in FIG. 9, there is a one-to-one correspondence between the sensed pressure and the temperature of refrigerant in the first evaporator 908. When the pressure sensed by the pressure sensor 938 indicates that the temperature of refrigerant in the first evaporator is above +36° F., the pressure sensor output signal activates the control unit 918, such as by activating a solenoid valve (not shown in FIG. 9), so that flow communication is established between the conduit 920 and the conduit 932, i.e., STATE 2.

Although flow communication is established between the conduits 920 and 932, refrigerant will be pulled through the first evaporator 908 only when the thermostat 926 has detected a need for cooling in the freezer compartment. For example, when it is preferred to maintain the freezer compartment air temperature at approximately 0° F., a temperature range of −2° F. to +2° F. is a typical range for the air temperature of the freezer compartment. When the air temperature of the freezer compartment is above +2° F., the thermostat 926 provides that power is supplied to the compressor unit 902. Subsequent to activation of the compressor unit 902, once the air temperature of the freezer compartment is below −2° F., the thermostat 926 cuts-off power to the compressor unit 902. When the compressor unit 902 is not activated, regardless of the configuration of the control unit 918, substantially no refrigeration effect is provided to the fresh food compartment and the freezer compartment.

When the temperature of refrigerant in the conduit 920 is above +36° F. and the temperature of the freezer compartment is above +2° F., the control unit 918 is disposed in STATE 2 and the compressor unit 902 is activated. Once the temperature of refrigerant within the fresh food compartment evaporator 908 is brought to below +26° F., then the pressure sensor 938 causes the control unit 918 to transition into STATE 1. Refrigerant will then be pulled through the freezer evaporator 924 until the temperature of the freezer compartment is below −2° F. Even when the control unit 918 is in STATE 1, the fresh food evaporator 908 has refrigerant pulled therethrough albeit at a rate slower than when the control unit 918 is in STATE 2. In order for the freezer evaporator 924 to have refrigerant pulled therethrough, the temperature of the refrigerant in the conduit 920 must be below +36° F. and the temperature of the freezer compartment must be above +2° F.

The system 900 illustrated and described above was implemented in a General Electric Company Household Refrigerant Model No. TBX25Z with a General Electric Company No. 800 Rotary-type compressor. For compressor unit cycling, the on-period was found to be 22.7 minutes and the off-period was found to be 33.5 minutes (40.4% on-time). Respective evaporator fans (not shown) were provided to blow air across the coils of each evaporator. Each fan was coupled through the thermostat 926 to the power supply, and when the thermostat 926 activated the compressor unit 902, both fans also were activated and blew air across its respective evaporator 908 and 924.

The exemplification refrigeration circuit 900 provides increased energy efficiency by utilizing a plurality of evaporators which operate at desired, respective, refrigeration temperatures. Further, by utilizing, in one embodiment, a single-stage compressor rather than a plurality of compressors or a compressor having a plurality of stages, increased costs associated with the improved energy efficiency are minimized. In addition to these advantages, and to provide even further energy use reduction, the fresh food evaporator 908 can be designed so that it does not need defrosting. For example, the fresh food evaporator can be selected to be of sufficient size to provide that the average temperature of the fresh food evaporator is above +32° F., as is well known in the art. At least in terms of energy use reduction, the embodiment 900 presently is the preferred embodiment.

It is contemplated that in some refrigeration systems, all of the energy efficiencies and reduced costs provided by the present invention may not be strictly necessary. As a result, others may attempt to modify the invention as described herein, such modifications resulting in varying efficiency and/or increased costs relative to the described embodiments. For example, a plurality of compressors or a compressor having a plurality of stages or any combination thereof, along with the refrigerant flow control means, may be utilized. Such modifications are possible, contemplated, and within the scope of the appended claims. Further, while the present invention is described herein sometimes with reference to a household refrigerator, it is not limited to practice with and/or in a household refrigerator.

While preferred embodiments have been illustrated and described herein, it will be obvious that numerous modifications, changes, variations, substitutions and equivalents, in whole or in part, will now occur to those skilled in the art without departing from the spirit and scope contemplated by the invention. Accordingly, it is intended that the invention herein be limited only by the scope of the appended claims.

What is claimed is:

1. A refrigerant, comprising:

compressor means;

condenser means connected to receive refrigerant discharged from said compressor means;

a fresh food compartment;

first evaporator means for refrigerating said fresh food compartment and connected to receive at least part of the refrigerant discharged from said condenser means;

a freezer compartment;

second evaporator means for refrigerating said freezer compartment and connected to receive at least part of the refrigerant discharged from said first evaporator means;

refrigerant flow control means connected to receive at least part of the refrigerant discharged from said first evaporator means and at least part of the refrigerant discharged from said second evaporator means and repeatedly operable to alternately connect said first and said second evaporator means in exclusive refrigerant flow relationship with said compressor means.

2. A refrigerator in accordance with claim 1 wherein said fresh food compartment is maintained at a first refrigerated temperature and said freezer compartment is maintained at a second, colder temperature.

3. A refrigerator in accordance with claim 1 further comprising first expansion means coupled in refrigerant flow relationship between said condenser means and said first evaporator means and second expansion means coupled in refrigerant flow relationship between said condenser means and said second evaporator means.

4. A refrigerator in accordance with claim 1 wherein said refrigerant flow control means comprises a plurality of flow controllers.

5. A refrigerator in accordance with claim 4 wherein one of said flow controllers comprises controllable valve means connected in refrigerant flow relationship between one of said evaporator means and said compressor means.

6. A refrigerator in accordance with claim 5 wherein another one of said flow controllers comprises a check valve connected in refrigerant flow relationship between the other of said evaporator means and said compressor means.

7. A refrigerator in accordance with claim 4 further comprising timer means and wherein one of said flow controllers comprises a solenoid controlled valve coupled to said timer means.

8. A refrigerator in accordance with claim 7 wherein said timer means causes said solenoid valve to open and close with a fixed duty cycle.

9. A refrigerator in accordance with claim 7 wherein said timer means causes said solenoid valve to open and close with a variable duty cycle.

10. A refrigerator in accordance with claim 4 wherein one of said flow controllers comprises a solenoid controlled valve operable between an open position permitting refrigerant flow and a closed position preventing refrigerant flow.

11. A refrigerant in accordance with claim 10 wherein another of said flow controllers comprises a check valve effective to permit refrigerant flow only when said solenoid controlled valve prevents refrigerant flow.

12. A refrigerator in accordance with claim 4 wherein operation of at least one of said flow controllers is user adjustable.

13. A refrigerator in accordance with claim 1 further including means for sensing a pressure representative of the pressure of refrigerant flowing in one of said evaporator means and responsive to a predetermined sensed pressure to cause said flow control means to connect a predetermined one of said evaporator means in refrigerant flow relationship with said compressor means.

14. A refrigerator in accordance with claim 1 further including means for sensing a temperature representative of the temperature of refrigerant flowing in one of said evaporator means and responsive to a predetermined sensed temperature to cause said flow control means to connect a predetermined one of said evaporator means in refrigerant flow relationship with said compressor means.

15. A refrigerator in accordance with claim 1 further including means for determining a temperature different between refrigerant in said first evaporator means and in said second evaporator means and responsive to a predetermined temperature difference to cause said flow control means to connect a predetermined one of said evaporator means in refrigerant flow relationship with said compressor means.

16. A refrigerator in accordance with claim 1 further including means for determining a pressure difference between refrigerant in said first evaporator means and in said second evaporator means and responsive to a predetermined pressure difference to cause said flow control means to connect a predetermined one of said evaporator means in refrigerant flow relationship with said compressor means.

17. A refrigerator in accordance with claim 1 further including means for sensing a physical attribute of the refrigerant flowing in one of said evaporator means and responsive to a predetermined sensed physical attribute to cause said flow control means to connect a predetermined one of said evaporator means in refrigerant flow relationship with said compressor means.

18. A refrigerator in accordance with claim 1 further including means for sensing mass flow rate of refrigerant flowing in one of said evaporator means and responsive to a predetermined mass flow rate to cause said flow control means to connect a predetermined one of said evaporator means in refrigerant flow relationship with said compressor means.

19. A refrigerator in accordance with claim 1 wherein said first evaporator means is effective to maintain said fresh food compartment between approximately +33° F. and approximately +47° F. and wherein said second evaporator means is effective to maintain said freezer compartment between approximately −10° F. and approximately +15° F.

20. A refrigerator in accordance with claim 1 wherein said first evaporator means is operated between approximately +15° F. and approximately +32° F. and said second evaporator is operated between approximately −30° F. and approximately 0° F.

21. A refrigerator in accordance with claim 1 further comprising first and second temperature sensors connected to said flow control means, said first temperature sensor being positioned to sense the temperature of said fresh food compartment and said second temperature sensor being positioned to sense the temperature of said freezer compartment.

22. A refrigerator in accordance with claim 21 wherein, when said fresh food compartment temperature is above a first threshold value, said first temperature sensor generates a temperature representative signal which enables said refrigerant flow control means to connect said first evaporator means in refrigerant flow relationship with said compressor means.

23. A refrigerator in accordance with claim 21 wherein, when said freezer compartment temperature is above a second threshold value, said second temperature sensor generates a temperature representative signal which enables said refrigerant flow control means to connect said second evaporator means in refrigerant flow relationship with said compressor means.

24. A refrigerator in accordance with claim 1 further comprising means for sensing the temperature of said fresh food compartment and the temperature of said freezer compartment and for controlling operation of said refrigerant flow control means in response to the difference in sensed temperatures.

25. A refrigerator in accordance with claim 1 wherein said refrigerant flow control means is user adjustable.

26. A refrigeration system, comprising:

compressor means;

condenser means connected to receive refrigerant from said compressor means;

first evaporator means connected to receive refrigerant from said condenser means;

phase separator means connected to receive refrigerant from said first evaporator means and to separate liquid refrigerant from vapor refrigerant;

refrigerant flow control means, said phase separator means being connected to discharge vapor refrigerant as a first input to said refrigerant flow control means; and second evaporator means connected to receive liquid refrigerant discharged from said phase separator means and to discharge refrigerant as a second input to said refrigerant flow control means, said refrigerant flow control means being effective to connect only one of its inputs to said compressor means at a time for connecting the corresponding one of said evaporator means in refrigerant flow relationship with said compressor means.

27. A refrigeration system in accordance with claim 26 further comprising means for controlling operation of said flow control means and effective to determine which evaporator means is connected in refrigerant flow relationship with said compressor means.

28. A refrigeration system in accordance with claim 27 wherein said means for controlling operation of said flow control means comprises timer means.

29. A refrigeration system in accordance with claim 26 wherein said flow control means comprises a first flow controller and a second flow controller.

30. A refrigeration system in accordance with claim 29 further including means for causing said first flow controller to switch between an open condition permitting refrigerant flow and a closed condition preventing refrigerant flow.

31. A refrigeration system in accordance with claim 30 wherein said second flow controller comprises a check valve effective to permit refrigerant flow only when said first controller prevents refrigerant flow.

32. A refrigeration system in accordance with claim 30 wherein said means for causing opening and closing of said first flow controller comprises timer means.

33. A refrigeration system in accordance with claim 30 wherein said means for causing opening and closing of said first flow controller comprises pressure sensing means.

34. A refrigeration system in accordance with claim 30 wherein said means for causing opening and closing of said first flow controller comprises temperature sensing means.

35. A refrigeration system in accordance with claim 30 wherein said means for causing opening and closing of said first flow controller comprises mass flow rate sensing means.

36. A refrigeration system in accordance with claim 30 wherein said means for causing the opening and closing of said first flow controller means comprises pressure difference determining means for determining a pressure difference between pressures representative of refrigerant in said first evaporator means and in said second evaporator means.

37. A refrigeration system in accordance with claim 30 wherein said means for causing opening and closing of said first flow controller means comprises temperature difference determining means for determining a temperature difference between temperatures representative of said first evaporator means and of said second evaporator means.

38. A refrigeration system, comprising:

compressor means;

a plurality of refrigerant flow conduit means;

refrigerant flow control means connected to control refrigerant flow between said conduit means and said compressor means and effective to selectively permit refrigerant flow alternately from each of said conduit means to said compressor means; and a timer means for controlling operation of said refrigerant flow control means for selecting the particular conduit means from which refrigerant is permitted to flow to said compressor means.

39. A refrigeration system in accordance with claim 38 wherein said timer means causes said flow control means to operate on a fixed duty cycle.

40. A refrigeration system in accordance with claim 38 wherein said timer means causes said flow control means to operate on a variable duty cycle.

41. A refrigeration system in accordance with claim 38 wherein said refrigerant flow control means comprises controllable valve means connected to selectively permit refrigerant flow between at least one of said refrigerant flow conduit means and said compressor means.

42. A refrigeration system in accordance with claim 41 wherein said controllable valve means is coupled to a timer.

43. A refrigeration system in accordance with claim 41 wherein said refrigerant flow control means further comprises a check valve connected to control refrigerant flow between another one of said refrigerant flow conduit means and said compressor means and said check valve permits refrigerant flow only when said controllable valve means does not permit refrigerant flow.

44. A refrigeration system in accordance with claim 41 wherein said controllable valve means comprises a solenoid controlled valve.

45. A refrigeration system in accordance with claim 38 wherein said refrigerant flow control means responds to a physical attribute representative of refrigerant in said system to control refrigerant flow therethrough.

46. A refrigeration system in accordance with claim 38 further comprising a plurality of evaporator means connected to respective ones of said conduit means and wherein said refrigerant flow control means responds to a sensed pressure representative refrigerant in one of said evaporator means for selecting the particular conduit means from which refrigerant is permitted to flow to said compressor means.

47. A refrigeration system in accordance with claim 38 further comprising a plurality of evaporator means connected to respective ones of said conduit means and wherein said refrigerant flow control means responds to a sensed temperature representative of refrigerant in one of said evaporator means for selecting the particular conduit means from which refrigerant is permitted to flow to said compressor means.

48. A refrigeration system in accordance with claim 38 further comprising a plurality of evaporator means connected to respective ones of said conduit means and wherein said refrigerant flow control means responds to a signal representative of the difference in pressures of the refrigerant which flows through a first and a second evaporator means respectively for selecting the particular conduit means from which refrigerant is permitted to flow to said compressor means.

49. A refrigeration system in accordance with claim 38 further comprising a plurality of evaporator means connected to respective ones of said conduit means and wherein said refrigerant flow control means responds to a signal representative of the difference in temperatures of the refrigerant which flows through a first and a second evaporator means respectively for selecting the particular conduit means from which refrigerant is permitted to flow to said compressor means.

50. A refrigeration system in accordance with claim 38 wherein said refrigerant flow control means responds to a sensed mass flow rate representative of refrigerant flow through said refrigeration system.

51. A refrigeration system in accordance with claim 38 wherein said refrigerant flow control means responds to a sensed density representative of refrigerant in flowing said refrigeration system.

52. A refrigeration system in accordance with claim 38 further comprising user adjustment means for providing selective control of refrigerant flow in said refrigeration system.

53. A refrigeration system, comprising:

compressor means;

condenser means connected to receive refrigerant discharged from said compressor means;

first evaporator means connected to receive at least a portion of the refrigerant discharged from said condenser means and second evaporator means connected to receive at least a portion of the refrigerant discharged from said first evaporator means;

flow control means connected to receive at least a portion of the refrigerant discharged from said first evaporator means and at least a portion of the refrigerant discharged from said second evaporator means;

said flow control means connected to said compressor means and repeatedly operable to alternately connect said first and said second evaporator means respectively in exclusive refrigerant flow relationship with said compressor means.

54. A refrigeration system as set forth in claim 53 further comprising means for controlling operation of said flow control means to determine which evaporator means is connected in refrigerant flow relationship with said compressor means.

55. A refrigeration system as set forth in claim 54 wherein said means for controlling operation of said flow control means comprises timer means.

56. A refrigeration system in accordance with claim 53 wherein said flow control means comprises a first flow controller and a second flow controller.

57. A refrigeration system in accordance with claim 56 further including means for causing said first flow controller to switch between an open condition permitting refrigerant flow and a closed condition preventing refrigerant flow.

58. A refrigeration system in accordance with claim 57 wherein said second flow controller comprises a check valve effective to permit refrigerant flow only when said first flow controller prevents refrigerant flow.

59. A refrigeration system in accordance with claim 57 wherein said means for causing opening and closing of said first flow controller comprises timer means.

60. A refrigeration system in accordance with claim 57 wherein said means for causing opening and closing of said first flow controller comprises pressure sensing means.

61. A refrigeration system in accordance with claim 57 wherein said means for causing opening and closing of said first flow controller comprises temperature sensing means.

62. A refrigeration system in accordance with claim 57 wherein said means for causing opening and closing of said first flow controller comprises mass flow rate sensing means.

63. A refrigeration system in accordance with claim 57 wherein said means for causing the opening and closing of said first flow controller means comprises pressure difference determining means for determining a pressure difference between pressure representative of refrigerant which flows in said first evaporator means and of refrigerant which flows in said second evaporator means.

64. A refrigeration system in accordance with claim 57 wherein said means for causing opening and closing of said first flow controller means comprises temperature difference determining means for determining a temperature difference between temperatures representative of said first evaporator means and of said second evaporator means.

65. A refrigeration system comprising:

a compressor;

a condenser connected to receive refrigerant discharged from said compressor;

a plurality of evaporators, a first one of said plurality of evaporators being connected to receive at least a portion of the refrigerant discharged from said condenser and the remainder of said plurality of evaporators being connected to receive at least a portion of the refrigerant discharged from another evaporator;

flow control means connected to receive a least a portion of the refrigerant discharged from each one of said plurality of evaporators, said flow control means connected to said compressor and repeatedly operable to alternately connect one of said plurality of evaporators respectively in exclusive refrigerant flow relationship with said compressor.

* * * * *